US009208758B2

(12) United States Patent
Brockman

(10) Patent No.: US 9,208,758 B2
(45) Date of Patent: Dec. 8, 2015

(54) UNIFIED OCTAVE/REGISTER KEY AND VENT FOR MUSICAL WIND INSTRUMENTS

(71) Applicant: University of Washington through its Center for Commercialization, Seattle, WA (US)

(72) Inventor: Michael Brockman, Seattle, WA (US)

(73) Assignee: University of Washington, Seattle, WA (US)

( * ) Notice: Subject to any disclaimer, the term of this patent is extended or adjusted under 35 U.S.C. 154(b) by 0 days.

(21) Appl. No.: 14/537,783

(22) Filed: Nov. 10, 2014

(65) Prior Publication Data

US 2015/0221289 A1 Aug. 6, 2015

Related U.S. Application Data

(63) Continuation-in-part of application No. 14/171,643, filed on Feb. 3, 2014, now abandoned, which is a continuation of application No. 13/654,636, filed on Oct. 18, 2012, which is a continuation of application No. 13/139,231, filed on Jun. 10, 2011.

(60) Provisional application No. 61/201,476, filed on Dec. 12, 2008.

(51) Int. Cl.
*G10D 9/00* (2006.01)
*G10D 9/04* (2006.01)

(52) U.S. Cl.
CPC ..... *G10D 9/043* (2013.01)

(58) Field of Classification Search
CPC ..... G10D 9/043
See application file for complete search history.

(56) References Cited

U.S. PATENT DOCUMENTS

| | | | | | |
|---|---|---|---|---|---|
| 1,817,487 | A | | 8/1931 | Heyworth et al. | |
| 2,083,048 | A | | 6/1937 | Bryant | |
| 2,226,536 | A | * | 12/1940 | Seimer | G10D 9/043 137/801 |
| 2,232,929 | A | | 2/1941 | Selmer | |
| 2,508,550 | A | * | 5/1950 | Stubbins | G10D 9/043 84/382 |
| 2,951,414 | A | * | 9/1960 | Christensen | G10D 7/066 84/382 |
| 3,564,574 | A | | 2/1971 | Singular | |
| 3,641,863 | A | | 2/1972 | Kanstul et al. | |
| 3,660,588 | A | | 5/1972 | Richardson | |
| 3,800,651 | A | | 4/1974 | Small | |
| 3,888,154 | A | | 6/1975 | Wesley | |
| 4,058,046 | A | | 11/1977 | Fajardo | |
| 4,127,052 | A | | 11/1978 | Thayer | |

(Continued)

FOREIGN PATENT DOCUMENTS

| | | | |
|---|---|---|---|
| EP | 498432 | B1 | 5/1996 |
| FR | 2493013 | A1 | 4/1982 |
| GB | 234590 | A | 6/1925 |

*Primary Examiner* — Robert W Horn
(74) *Attorney, Agent, or Firm* — Perkins Coie LLP

(57) ABSTRACT

The present technology relates generally to musical wind instrument key mechanisms, and more particularly to the octave or register vents that are employed on musical wind instruments to cause the instrument to play pitches an octave or more higher in frequency relative to the frequency obtained prior to actuation of the vent. In some embodiments, an octave/register key for affixing to a musical wind instrument in which an air column is formed includes a core having a core aperture therein. The core is reversibly moveable between a first position in which the core aperture is in fluid communication with the air column and a second position in which the core aperture is out of fluid communication with the air column.

20 Claims, 23 Drawing Sheets

(56) References Cited

U.S. PATENT DOCUMENTS

| | | | | | |
|---|---|---|---|---|---|
| 4,672,878 | A | | 6/1987 | Senior | |
| 4,714,001 | A | * | 12/1987 | Kergomard | G10D 9/005 84/380 R |
| 4,798,122 | A | | 1/1989 | Gisler et al. | |
| 4,905,564 | A | | 3/1990 | Thayer | |
| 4,996,902 | A | | 3/1991 | Hulot | |
| 5,237,902 | A | | 8/1993 | Hamanaga | |
| 5,686,678 | A | | 11/1997 | Greenhoe | |
| 5,900,563 | A | | 5/1999 | Leonard | |
| 5,965,833 | A | | 10/1999 | Lindberg | |
| 6,018,114 | A | | 1/2000 | Hamanaga | |
| 6,124,537 | A | * | 9/2000 | de Lancie | G10D 7/06 84/380 R |
| 6,143,969 | A | | 11/2000 | Lin | |
| 6,255,571 | B1 | | 7/2001 | Takahashi | |
| 7,112,735 | B2 | | 9/2006 | Shire | |
| 7,667,117 | B2 | | 2/2010 | Wasser et al. | |
| 8,314,318 | B2 | * | 11/2012 | Brockman | G10D 9/043 84/386 |
| 8,334,447 | B2 | * | 12/2012 | Masuda | G10D 7/00 84/381 |
| 2004/0003702 | A1 | | 1/2004 | Ahrens | |
| 2010/0236379 | A1 | | 9/2010 | Wilk | |
| 2011/0239843 | A1 | | 10/2011 | Brockman | |
| 2015/0221289 | A1 | * | 8/2015 | Brockman | G10D 9/043 84/386 |

* cited by examiner

UNIFIED OCTAVE/REGISTER KEY AND VENT FOR MUSICAL WIND INSTRUMENTS

CROSS-REFERENCE TO RELATED APPLICATIONS

The present application claims the benefit of the following applications:

U.S. patent application Ser. No. 14/171,643 filed Feb. 3, 2014;

U.S. patent application Ser. No. 13/654,636, filed Oct. 18, 2012;

U.S. patent application Ser. No. 13/139,231, filed Dec. 11, 2009, now U.S. Pat. No. 8,314,318; and U.S. Provisional Patent Application No. 61/201,476, filed Dec. 12, 2008.

All of the foregoing applications are incorporated herein by reference in their entireties. Further, components and features of embodiments disclosed in the applications incorporated by reference may be combined with various components and features disclosed and claimed in the present application.

TECHNICAL FIELD

The disclosed technology relates generally in its several embodiments to musical wind instrument key mechanisms, and more particularly to the octave or register vents (and the keys used to open and/or close the vents) that are employed on musical wind instruments (such as the saxophone, clarinet, oboe, bassoon, etc.) to cause the instrument to play pitches an octave or more higher in frequency relative to the frequency obtained prior to actuation of the vent.

BACKGROUND

Musical wind instruments in the "woodwind family" operate on the principle that air is blown over a reed (or a sharp-edged surface, as on a flute) to set into vibration the air column inside an instrument, Along the length of the instrument's body are numerous large holes (hereafter referred to as "tone holes") that, when closed or covered, increase the length of the air column inside the instrument. The pitch or note that the instrument sounds when played is determined by the length of the air column, and therefore, by the number of tone holes that are closed. Generally, the greater the number of tone holes covered, the lower the pitch that is produced.

Some woodwind instruments (such as the saxophone, clarinet, bassoon, and oboe) have very small holes (typically of less than 0.5 cm in diameter) positioned at special points along the length of the instrument's body, and that function as "octave vents" or "register vents." These vents work by allowing a very small amount of air pressure to escape from inside the instrument. This localized release partially interrupts the vibration of the air column moving inside the instrument when a musician is playing it. Allowing a small amount of air pressure to escape through the vent causes the frequency of the note being played on the instrument to jump an octave or more higher as a function of the harmonic properties of the air column, which are influenced by a number of factors including the length of the air column and the position of the vent along the air column.

Octave/register vents are normally covered or closed by some device, such as a lever that is pressed by the musician's finger. The lever (often referred to as a "register key") normally has a flat, resilient or flexible surface at one end (usually a round disk of cork, rubber or leather) that covers the vent, preventing air from escaping out of the vent. The resilient or flexible material (hereafter referred to as a "pad") covers the vent hole and creates a seal through which air cannot pass. In most cases, an octave/register vent remains closed by the register key and its pad, with a spring holding the key in closed position, until the musician chooses to press the key, thereby opening the vent.

SUMMARY

As described in greater detail below and in the Drawings, according to certain embodiments of the disclosed technology there is provided an octave/register key for affixing to a musical wind instrument in which an air column is formed, comprising: a sleeve having (i) at least one open end, (ii) a sidewall separating an interior chamber from an exterior surface, and (iii) at least one sleeve sidewall aperture; and a core that is coaxially and slidably disposed within the interior chamber of the sleeve, said core having an opening (and in some embodiments one or more openings) and being capable of reversibly sliding within the interior chamber of the sleeve to establish fluid communication, via said opening(s), between the air column of the musical wind instrument and the sleeve sidewall aperture. In other embodiments, the sleeve is absent and the core opening establishes fluid communication directly between the air column and ambient air. In certain further embodiments fluid communication is established along a path that is substantially coaxial with the sleeve and the core, and in certain still further embodiments the path is substantially perpendicular to the air column. In certain embodiments the octave/register key is capable of being operably affixed to a tone hole key that is present on the musical wind instrument, for instance, such that both the tone hole key and the octave/register key can be actuated with a single finger. In certain embodiments air cannot pass through the opening(s) of the core to the exterior surface of the sleeve when the opening of the core is not aligned (or in situations where more than one core opening is present, when no opening to the core is aligned) in fluid communication with the sleeve sidewall aperture. In certain further embodiments the core comprises a base plate that is capable of forming an airtight seal with at least one of (i) a body portion of the musical wind instrument, and (ii) a tone hole pad of a tone hole key to which the octave/register key is affixed. In certain embodiments the octave/register key comprises an actuator that upon actuation (e.g., a push-button that upon being pushed) causes the opening (and in some embodiments, at least one opening of one or more openings) in the core and the sleeve sidewall aperture to align. In certain embodiments, air entering the opening (and in some embodiments one or more openings) of the core can pass through said opening and through the sleeve sidewall aperture when at least a portion of the opening of the core (and in some embodiments at least a portion of at least one of the one or more openings) and the sleeve sidewall aperture are aligned. In certain embodiments the actuator comprises a closed end of the core and wherein actuation comprises applying pressure to said closed end. In certain embodiments air cannot pass through the opening of the core to the exterior surface of the sleeve when the opening of the core is not aligned in fluid communication with the sleeve sidewall aperture. In certain embodiments the octave/register key comprises an actuation-reversal element that causes the opening of the core and the sleeve sidewall aperture to be non-aligned after actuation. In certain further embodiments the actuation-reversal element is selected from a spring, a magnet, a pair of opposed magnets, an elastic closure and a lever. In certain embodiments the herein described octave/register key comprises a substantially airtight seal between the sleeve sidewall and the core, and in certain further embodiments the substantially airtight seal comprises a resilient material that is non-liquid at 30° C. In certain embodiments the non-liquid resilient material is selected from rubber, silicone, cork and leather. In certain embodiments of the herein described octave/register key, the musical wind instrument is selected from a woodwind instrument and a brass instrument. In certain embodiments the woodwind instrument is selected from a saxophone, a clarinet, a flute and a double-reed instrument. In certain embodiments the woodwind instrument is selected from a sopranino saxophone, a soprano saxophone, an alto saxophone, a C-melody saxophone, a tenor saxophone, a baritone saxophone, a bass saxophone, a clarinet, a bass clarinet, a flute, a bass flute, an oboe, a bassoon, a contrabassoon, an English horn, a recorder, a blockflute, a tarogato, a contrabass saxophone, a crumhorn, a bass oboe, a soprillo saxophone, an alto clarinet, an Eb clarinet, a subcontrabass saxophone, a piccolo, and a shawm. In certain embodiments the brass instrument is selected from a trumpet, a flugelhorn, a bugle, a trombone, a mellophone, a euphonium, a baritone horn, a tuba, a French horn and a sousaphone.

In other embodiments of the disclosed technology there is provided a tone hole key, comprising an octave/register key according to any of the above described embodiments. In other embodiments of the disclosed technology there is provided a musical wind instrument, comprising one or more octave/register keys according to any of the above described embodiments.

Turning to another aspect of the disclosed technology, there is provided a method of producing one or more harmonics of a fundamental pitch on a musical wind instrument, comprising (a) establishing an air column in the wind instrument under conditions and for a time sufficient to produce a pitch which comprises the fundamental pitch and that can be predicted as a function of length of the air column; and (b) substantially disrupting vibration of the air column such that the fundamental pitch is removed from the pitch produced in (a), said step of disrupting comprising actuating an octave/register key on the wind instrument, wherein said octave/register key comprises (I) a sleeve having (i) at least one open end, (ii) a sidewall separating an interior chamber from an exterior surface, and (iii) at least one sleeve aperture; and (II) a core that is coaxially and slidably disposed within the interior chamber of the sleeve, said core having an opening (and in some embodiments one or more openings) and being capable of reversibly sliding within the interior chamber of the sleeve to establish fluid communication, via said opening (s), between the air column of the musical wind instrument and the sleeve sidewall aperture, wherein: (1) air cannot pass from the air column through the opening (or through an opening when more than one opening are present) of the core to the exterior surface of the sleeve when the opening of the core and the sleeve sidewall aperture are not aligned in fluid communication, and (2) air entering the opening (or an opening when more than one opening are present) of the core from the air column can pass through the opening of the core and through the sleeve sidewall aperture when the opening of the core and the sleeve sidewall aperture are aligned, and (3) said actuating comprises sliding the core relative to the sleeve to align the opening(s) of the core with the sleeve sidewall aperture.

In certain embodiments of the disclosed technology, there is provided an octave/register key for a musical wind instrument, comprising at least two coaxially disposed chambers, each having (a) a sidewall separating an interior compartment from an exterior surface; and (b) at least one open end, a first of the chambers comprising a sleeve and a second of the chambers fitting slidably within said sleeve of the first chamber, wherein (i) the sidewall of the first chamber comprises one or a plurality of first chamber sidewall apertures, (ii) the sidewall of the second chamber comprises one or a plurality of second chamber sidewall apertures, and (iii) the first and second chamber sidewall apertures are positioned in their respective sidewalk such that the second chamber can reversibly slide within the first chamber to align the first chamber sidewall apertures with the second chamber sidewall apertures to bring the interior compartment of the second chamber into fluid communication with the exterior surface of the first chamber. In certain further embodiments the octave/register key comprises an actuator that upon actuation causes the first and second chamber sidewall apertures to align. In certain further embodiments, air entering the open end of the second chamber can pass through the first and second chamber sidewall apertures when the first and second chamber sidewall apertures are aligned. In certain other embodiments the actuator comprises a closed end of the second chamber and actuation comprises applying pressure to said closed end. In certain embodiments, air cannot pass through the second chamber sidewall aperture to the exterior surface of the first chamber when the first and second chamber sidewall apertures are not aligned in fluid communication. In certain other embodiments, the octave/register key comprises an actuation-reversal element that causes the first and second chamber sidewall apertures to be non-aligned after actuation. In certain embodiments the actuation-reversal element is selected from a spring, a magnet, a pair of opposed magnets, an elastic closure and a lever. In certain embodiments the octave/register key comprises a substantially airtight seal between the first chamber sidewall and the exterior surface of the second chamber. In certain embodiments the musical wind instrument is selected from a woodwind instrument and a brass instrument. In certain embodiments the woodwind instrument is selected from a saxophone, a clarinet, a flute and a double-reed instrument. In certain embodiments the woodwind instrument is selected from a sopranino saxophone, a soprano saxophone, an alto saxophone, a C-melody saxophone, a tenor saxophone, a baritone saxophone, a bass saxophone, a clarinet, a bass clarinet, a flute, a bass flute, an oboe, a bassoon, a contrabassoon, an English horn, a recorder, a blockflute, a tarogato, a contrabass saxophone, a crumhorn, a bass oboe, a soprillo saxophone, an alto clarinet, an Eb clarinet, a subcontrabass saxophone, a piccolo, and a shawm. In certain embodiments the brass instrument is selected from a trumpet, a flugelhorn, a bugle, a trombone, a mellophone, a euphonium, a baritone horn, a tuba, a French horn and a sousaphone. In certain embodiments of the disclosed technology there is provided a musical wind instrument, comprising one or more octave/register keys, each of said octave/register keys comprising at least two coaxially disposed chambers, each having (a) a sidewall separating an interior compartment from an exterior surface; and (b) at least one open end, a first of the chambers comprising a sleeve and a second of the chambers fitting slidably within said sleeve of the first chamber, wherein: (i) the sidewall of the first chamber comprises one or a plurality of first chamber sidewall apertures, (ii) the sidewall of the second chamber comprises one or a plurality of second chamber sidewall apertures, (iii) the first and second chamber sidewall apertures are positioned in their respective sidewalls such that the second chamber can reversibly slide within the first chamber to align the first chamber sidewall apertures with the second chamber sidewall apertures to bring the interior compartment of the second chamber into fluid communication with the exterior surface of the first chamber, (iv) air cannot pass through the second chamber sidewall aperture to the exterior surface of the first chamber when the first and second chamber sidewall apertures are not aligned in fluid communication, and (v) air entering the open end of the second chamber can pass through the first and second chamber sidewall apertures when the first and second chamber sidewall apertures are aligned.

In another embodiment, the disclosed technology provides a method of producing one or more harmonics of a fundamental pitch on a musical wind instrument, comprising (a) establishing an air column in the wind instrument under conditions and for a time sufficient to produce a pitch which comprises the fundamental pitch and that can be predicted as a function of length of the air column; and (b) substantially disrupting vibration of the air column such that the fundamental pitch is removed from the pitch produced in (a), said step of disrupting comprising actuating a push-button octave/register key on the wind instrument, wherein said octave/register key comprises at least two coaxially disposed chambers, each having (I) a sidewall separating an interior compartment from an exterior surface; and (II) at least one open end, a first of the chambers comprising a sleeve and a second of the chambers fitting slidably within said sleeve of the first chamber, wherein (i) the sidewall of the first chamber comprises one or a plurality of first chamber sidewall apertures, (ii) the sidewall of the second chamber comprises one or a plurality of second chamber sidewall apertures, (iii) the first and second chamber sidewall apertures are positioned in their respective sidewalls such that the second chamber can reversibly slide within the first chamber to align the first chamber sidewall apertures with the second chamber sidewall apertures to bring the interior compartment of the second chamber into fluid communication with the exterior surface of the first chamber, (iv) air cannot pass through the second chamber sidewall aperture to the exterior surface of the first chamber when the first and second chamber sidewall apertures are not aligned in fluid communication, and (v) air entering the open end of the second chamber from the air column can pass through the first and second chamber sidewall apertures when the first and second chamber sidewall apertures are aligned, and wherein said actuating comprises sliding the second chamber to align the first and second chamber sidewall apertures. In certain embodiments there is provided an octave/register key according to any of the herein described embodiments which comprises an actuator that comprises a push-button, thereby to provide a push-button octave/register key.

DETAILED DESCRIPTION

The disclosed technology provides in certain embodiments as described herein an octave/register key for a musical wind instrument, which key for the first time permits a wind instrument player readily to produce a desired sound based on virtually any pitch of which the instrument is capable, by altering with superior accuracy and ease the pitch and tonal characteristics emitted by the instrument, by an octave or other higher frequency harmonic, as desired. The present disclosure contemplates embodiments in which one or more additional octave/register keys may be placed anywhere on the instrument as described herein, with each key being so placed as to render the instrument capable of delivering exceptional accuracy of pitch and response to the user. These and related embodiments provide surprising and unprecedented facility and versatility to the wind instrument player, including, for example, the ability to raise a pitch by an octave or other desired harmonic interval from any of a number of key positions where such an ability was not previously possible, and also including, for example, refinements in intonation across the range of pitches produced by the musical instrument (i.e., improvements in the degree to which low, mid-range and high notes played by the instrument are in tune with one another).

The herein described embodiments can be incorporated into the design of a new wind instrument and/or can be incorporated as retrofits to existing instruments, and offer numerous advantages as will become readily apparent based on reference to the description below and the accompanying Drawings. The presently disclosed octave/register key is not expensive to produce or install, does not involve extensive additions to or substitutions of well-known existing musical instrument key designs, and hence does not add significant weight to the instrument nor require the musical wind instrument player to learn a completely new technique for instrumental playing such as entirely new keying or fingering patterns.

Figure 1A:
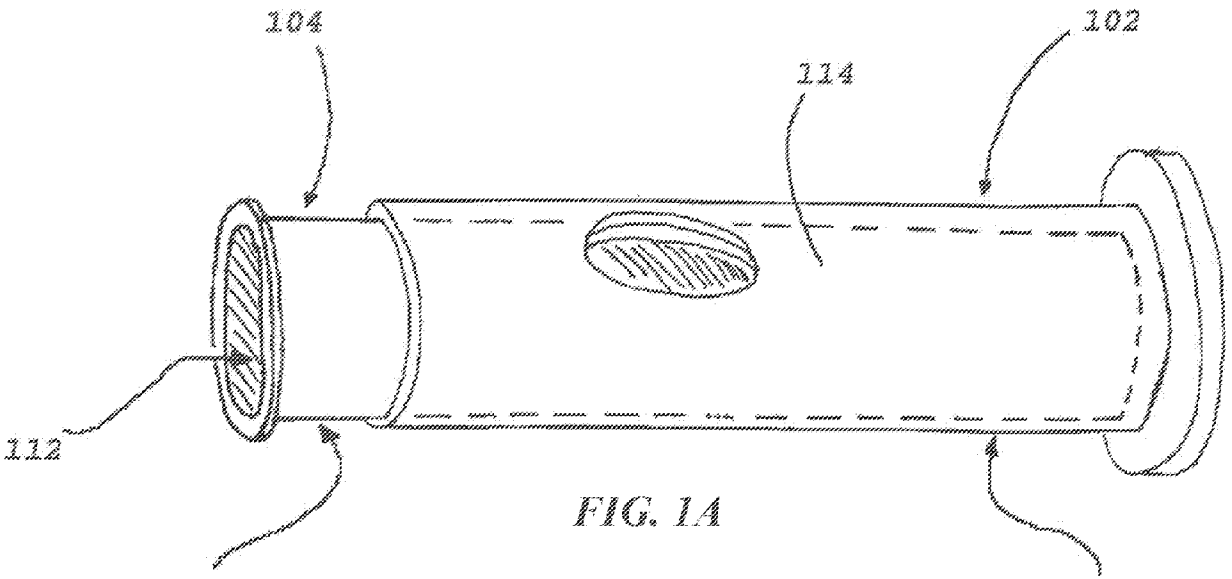
FIG. 1A is a front isometric view of an octave/register key in an open position and configured in accordance with embodiments of the technology.
Figure 1B:
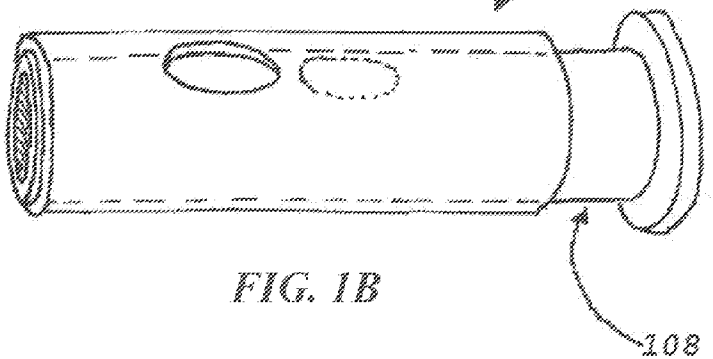
FIG. 1B is a front isometric view of the octave/register key of FIG. 1A in a closed position and configured in accordance with embodiments of the technology.

FIG. 1 shows an exemplary octave/register key 106 in open (FIG. 1A) and closed (FIG. 1B) positions. The octave/register key has a sleeve 102 in which slidably fits a core 108 that has an opening 112.

Figure 2A:
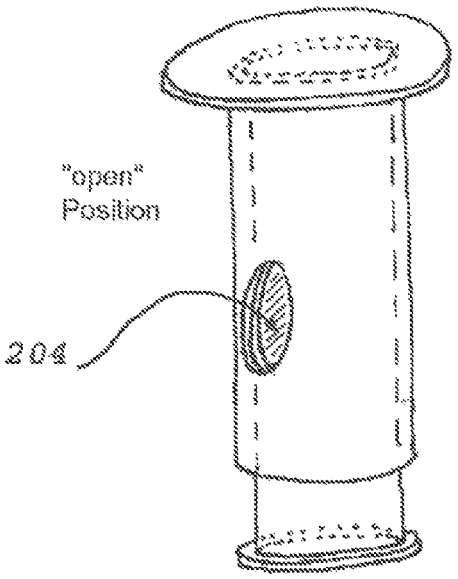
FIGS. 2A and 2B are front isometric views of an octave/register key in open and closed positions, respectively, and configured in accordance with embodiments of the technology.
Figure 2B:
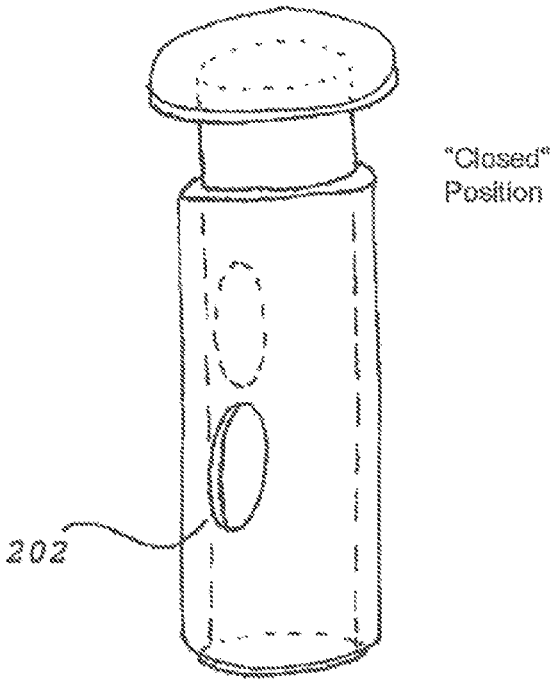

FIG. 2 shows an exemplary octave/register key in open (FIG. 2A) and closed (FIG. 2B) positions. The sleeve has a sidewall aperture 202 and the core has an opening in the form of a sidewall aperture 204.

Figure 3A:
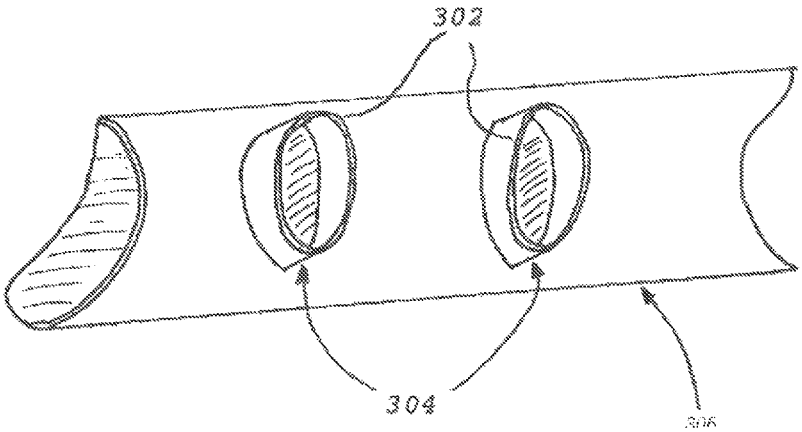
FIG. 3A is a front isometric view of tone holes on tone hole chimneys along the body of a musical wind instrument and configured in accordance with embodiments of the technology.
Figure 3B:
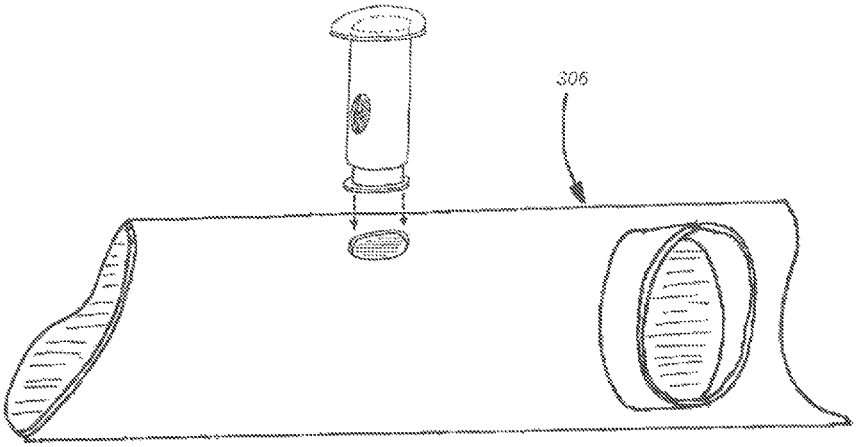
FIG. 3B is a front isometric view of the wind instrument of FIG. 3A having an octave/register key attached thereto and configured in accordance with embodiments of the technology.
Figure 4A:
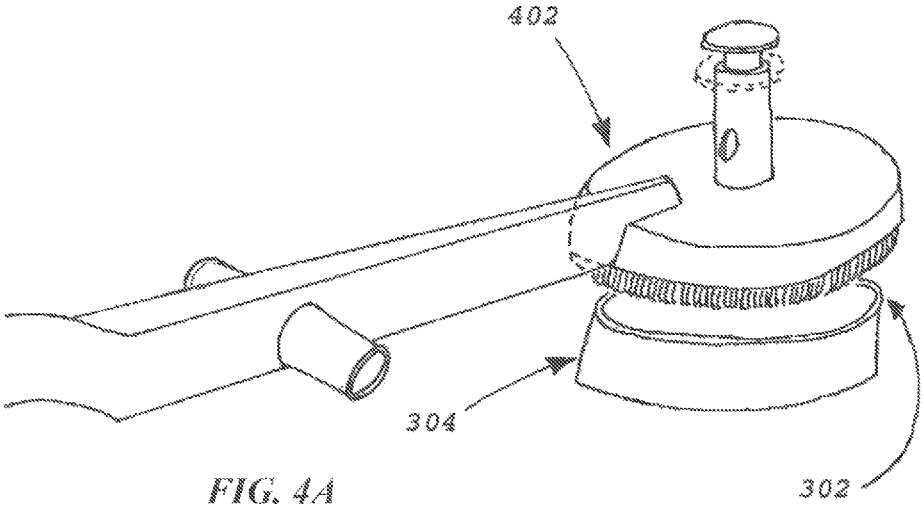
FIG. 4A is a top isometric view of an octave/register key affixed to a tone hole key/lever on a woodwind instrument and configured in accordance with embodiments of the technology.
Figure 4B:
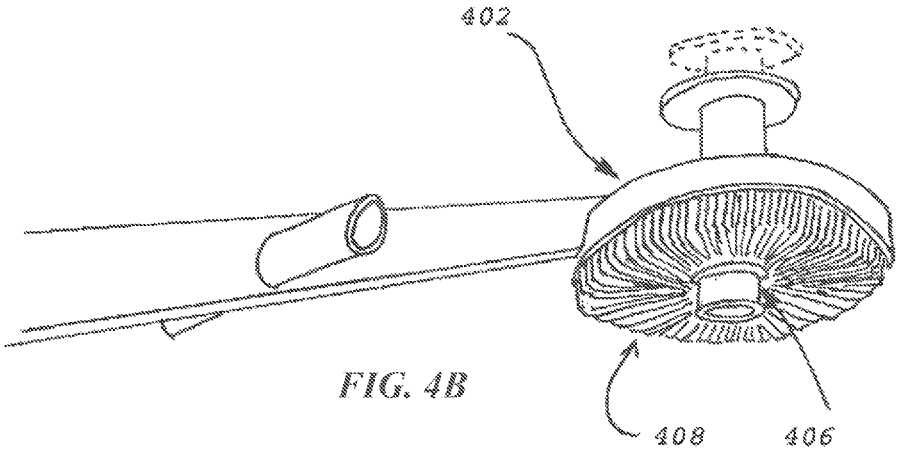
FIG. 4B is a bottom isometric view of the tone hole key/lever on the woodwind instrument of FIG. 4A configured in accordance with embodiments of the technology.

FIG. 3 shows exemplary tone holes 302 on tone hole chimneys 304 along the body of a musical wind instrument 306 (FIG. 3A) and affixation of an exemplary octave/register key to the body of a musical instrument (FIG. 3B). FIG. 4 shows affixation of an exemplary octave/register key to a tone hole key/lever 402 on a woodwind instrument (FIG. 4A) and protrusion of a portion of the inner (second) chamber 406 with open end through the tone hole key pad 408 (FIG. 4B) when the octave/register key is in the open position.

Figure 5A:
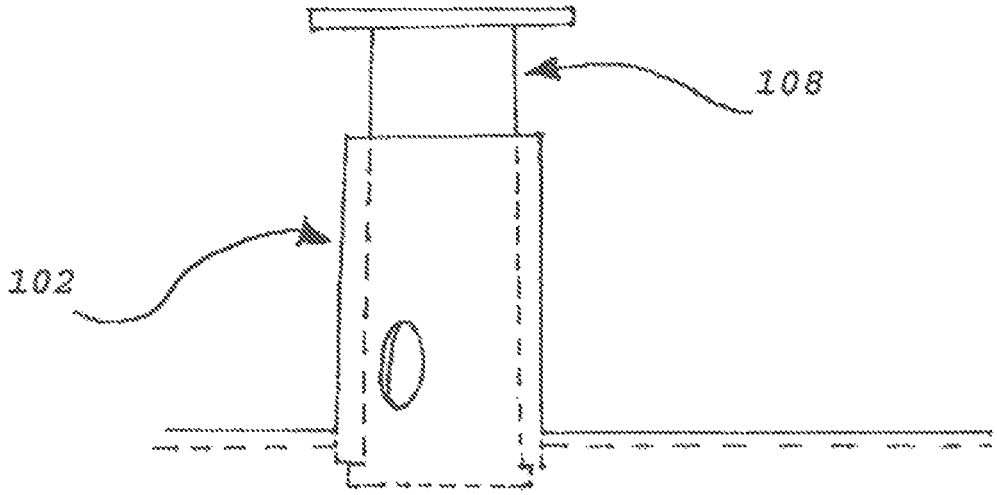
FIGS. 5A and 5B are front views of an octave/register key in closed and open positions, respectively, and configured in accordance with embodiments of the technology.
Figure 5B:
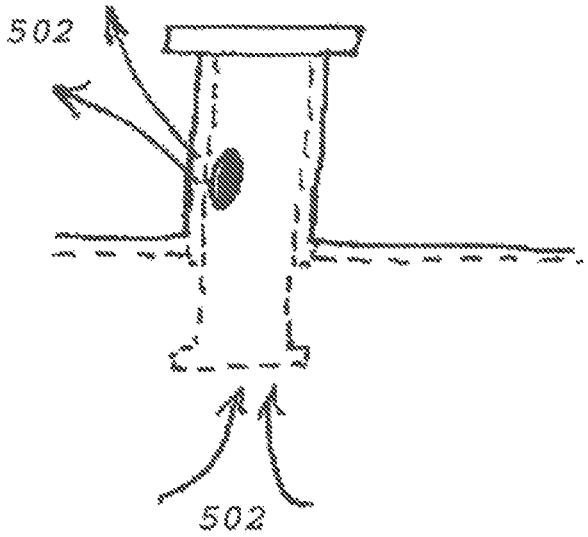

FIG. 5 shows an exemplary octave/register key in closed (FIG. 5A) and open (FIG. 5B) positions; arrows 502 indicate direction of air flow upon actuation.

Figure 6A:
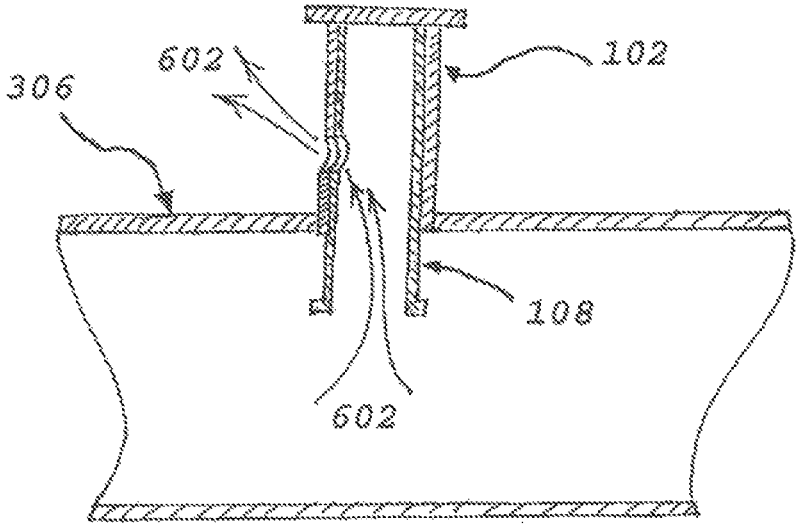
FIG. 6A is a cross-sectional view of an octave/register key in an open orientation and positioned on the body of a musical wind instrument and configured in accordance with embodiments of the technology.
Figure 6B:
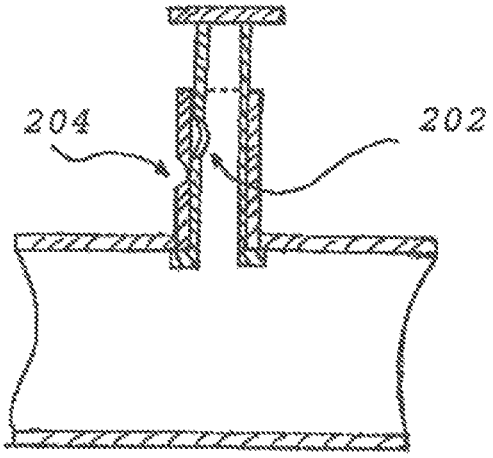
FIG. 6B is a cross-sectional side view of the octave/register key of FIG. 6A in a closed orientation and configured in accordance with embodiments of the technology.

FIG. 6 shows a cutaway view of positioning of an exemplary octave/register key on the body of a musical wind instrument in the closed position (FIG. 6B) and protrusion of a portion of the inner (second) chamber sidewall with open end into the wind instrument air column when the octave/register key is in the open position (FIG. 6A), permitting escape of air through the aligned first and second chamber sidewall apertures; arrows 602 indicate direction of air flow upon actuation.

Figure 7:
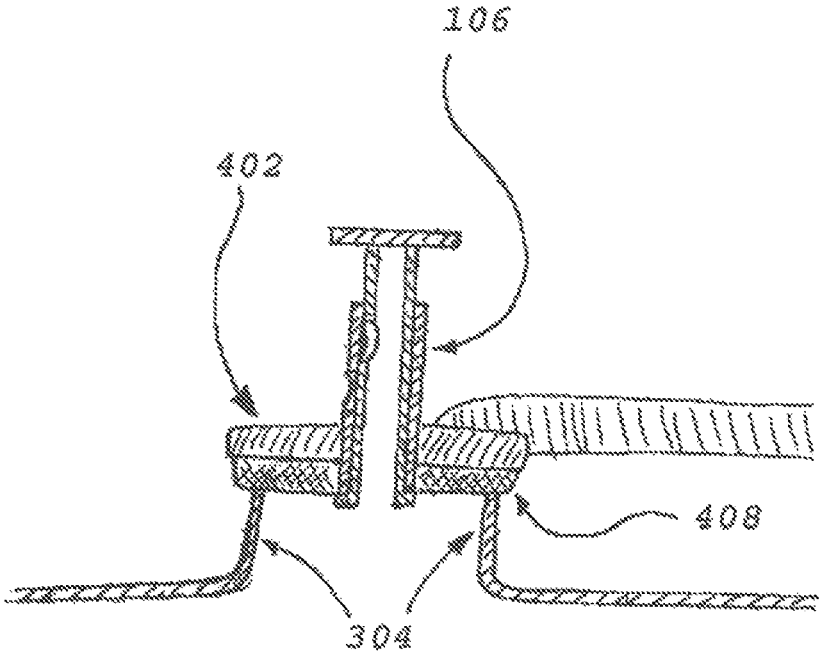
FIG. 7 is a cross-sectional side view of an octave/register key as it is attached to a tone hole key of a musical instrument and configured in accordance with embodiments of the technology.

FIG. 7 shows a cutaway side view of an exemplary octave/register key as it is attached to a tone hole key/lever of a musical instrument.

Figure 8:
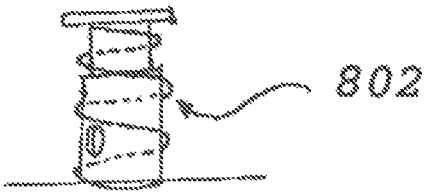
FIG. 8 is a side view of an octave/register key having an actuation reversal element and configured in accordance with embodiments of the technology.

FIG. 8 shows a side view of an exemplary octave/register key with the application of an actuation-reversal element that comprises a helical (coil) spring 802 that holds the key in closed position, until the key is actuated.

Figure 9A:
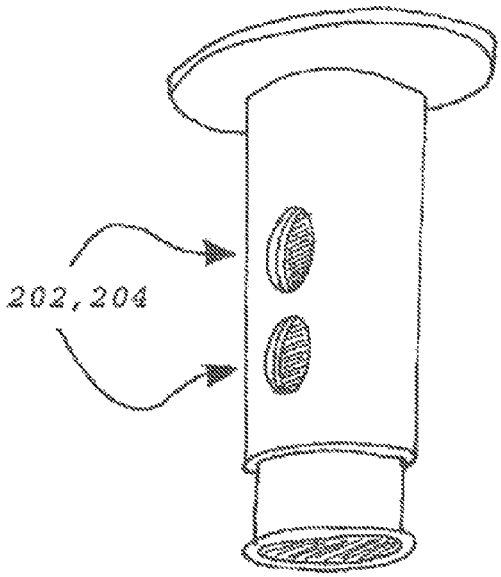
FIGS. 9A and 9B are front views of an octave/register key having a plurality of sleeve sidewall apertures and configured in accordance with embodiments of the technology.
Figure 9B:
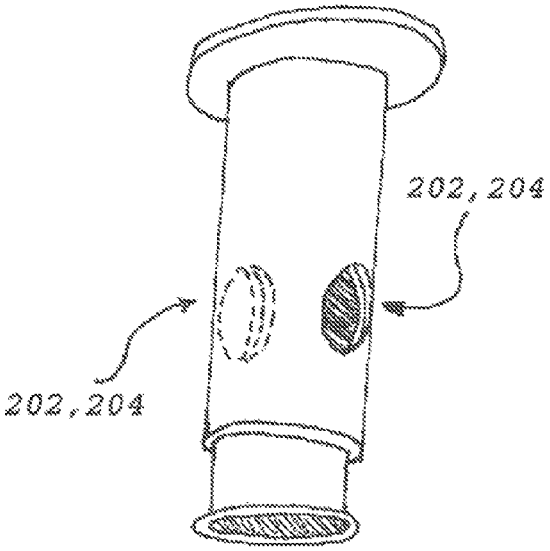

FIG. 9 shows an octave/register key having a plurality of sleeve sidewall apertures.

Figure 10A:
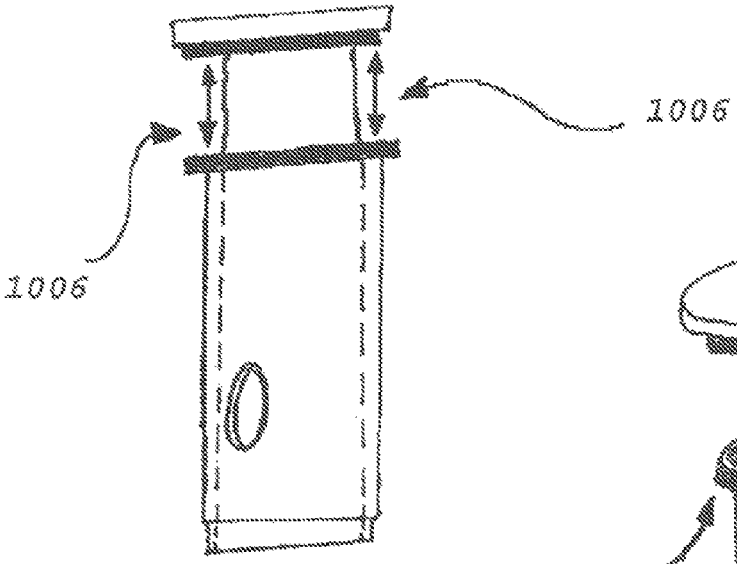
FIGS. 10A and 10B are front views of an octave/register key having an actuation reversal element and configured in accordance with embodiments of the technology.
Figure 10B:
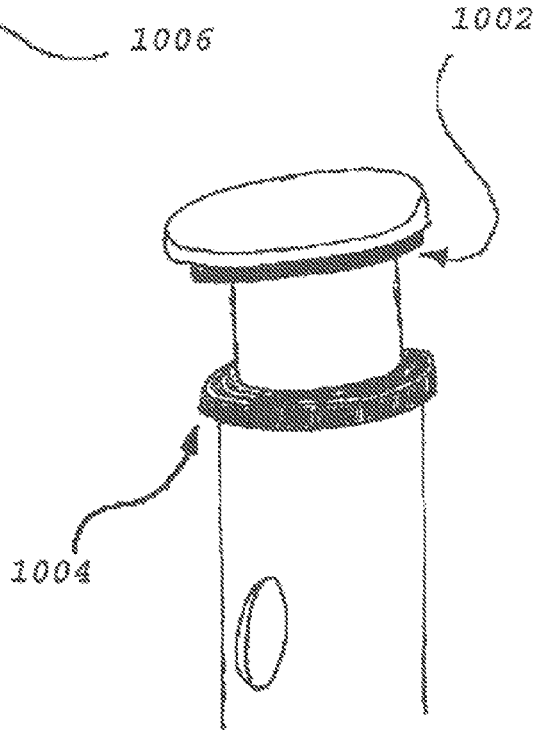

FIG. 10 shows an embodiment of the octave/register key (FIGS. 10A and 10B), in which an actuation reversal element is present in the form of a pair of opposing magnets, a first one 1002 of which is affixed to and positioned around the exterior surface of the core and a second one 1004 of which is affixed to the exterior surface of the sleeve sidewall such that it repulsively engages the first magnet in magnetic repulsion. Arrows 1006 indicate the direction in which the two opposing magnets repel one another as a means of actuation-reversal that holds the key in closed position, until the key is actuated.

Figure 11:
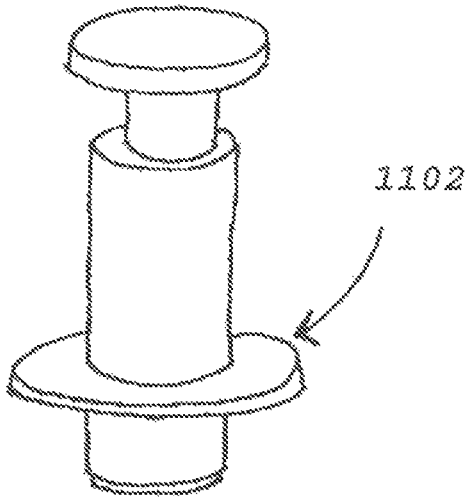
FIG. 11 is a front isometric view of an octave/register key having a base plate and configured in accordance with embodiments of the technology.

FIG. 11 shows an embodiment of the octave/register key in which a base plate 1102 is attached to the exterior surface of the sleeve, to provide strength and stability to the connection between the octave/register key and the surface of the musical instrument or tone hole key to which it is affixed.

Figure 12:
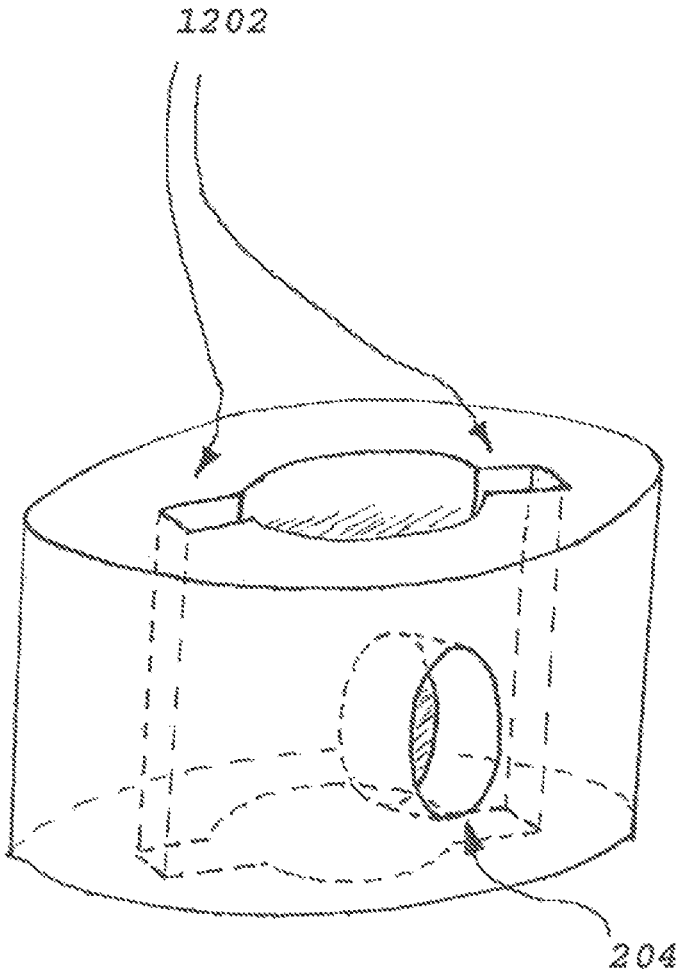
FIG. 12 is a front isometric view of a sleeve portion of an octave register key configured in accordance with embodiments of the technology.

FIG. 12 shows the sleeve in an embodiment of the octave/register key in which the sleeve sidewall comprises a pair of notches 1202 that promote alignment of the core opening with the sleeve sidewall aperture by preventing rotation of the core within the sleeve.

Figure 13:
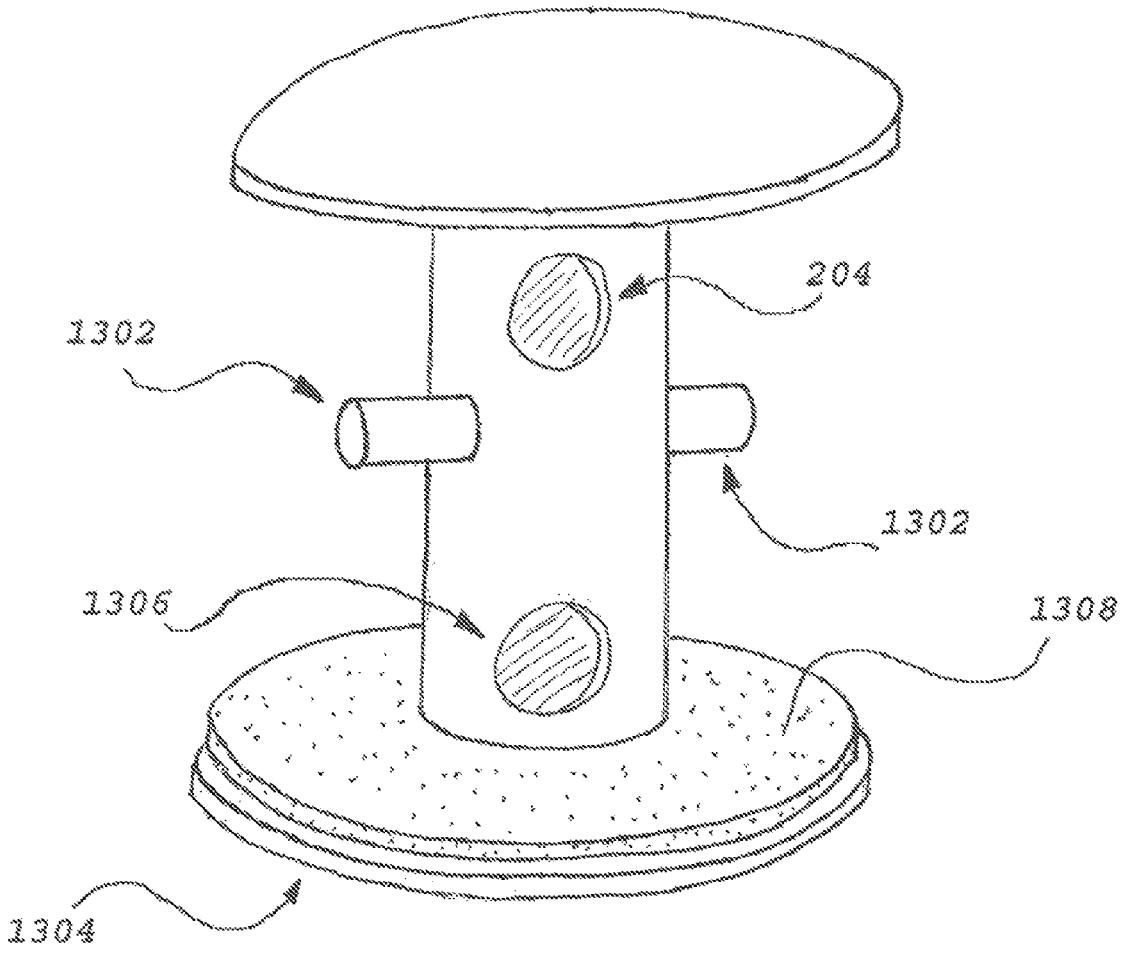
FIG. 13 is a front isometric view of a core portion of an octave/register key configured in accordance with embodiments of the technology.

FIG. 13 shows the core in an embodiment of the octave/register key in which the core comprises a pair of pegs 1302 that engage notches in the sleeve sidewall, to promote alignment of the core opening with the sleeve sidewall apertures by preventing rotation of the core within the sleeve. The core also comprises a base plate 1304 having a seal 1308 that is capable of forming an airtight seal with at least one of (i) a body portion of the musical wind instrument, and (ii) a tone hole pad of a tone hole key to which the octave/register key is affixed. The seal 1308 is formed of resilient sealing material that is adheringly affixed to the base plate of the core and that facilitates formation by the base plate of an airtight seal. A core opening 1306 is positioned to come into fluid communication with the interior of the musical instrument when the octave/register key is actuated.

Figure 14:
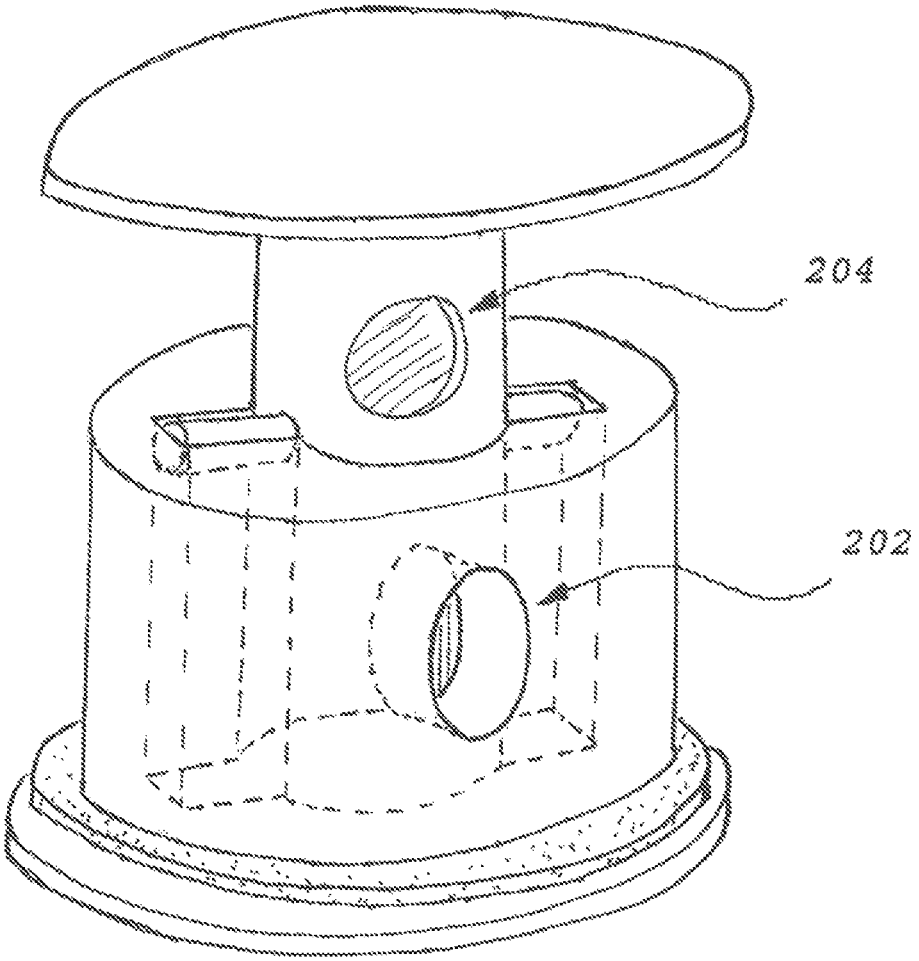
FIG. 14 is a front isometric view of an octave register key having engagement portions and configured in accordance with embodiments of the technology.

FIG. 14 shows an embodiment of the octave/register key in which the core comprises a pair of pegs that engage notches in the sleeve chamber sidewall, to promote alignment of the core opening(s) and sleeve sidewall aperture(s) by preventing rotation of the core within the sleeve, and a base plate that is capable of forming an airtight seal with at least one of (i) a body portion of the musical wind instrument, and (ii) a tone hole pad of a tone hole key to which the octave/register key is affixed. The core opening provides fluid communication from the interior of the musical instrument to the sleeve exterior via the sleeve sidewall aperture, when the octave/register key is actuated.

Figure 15:
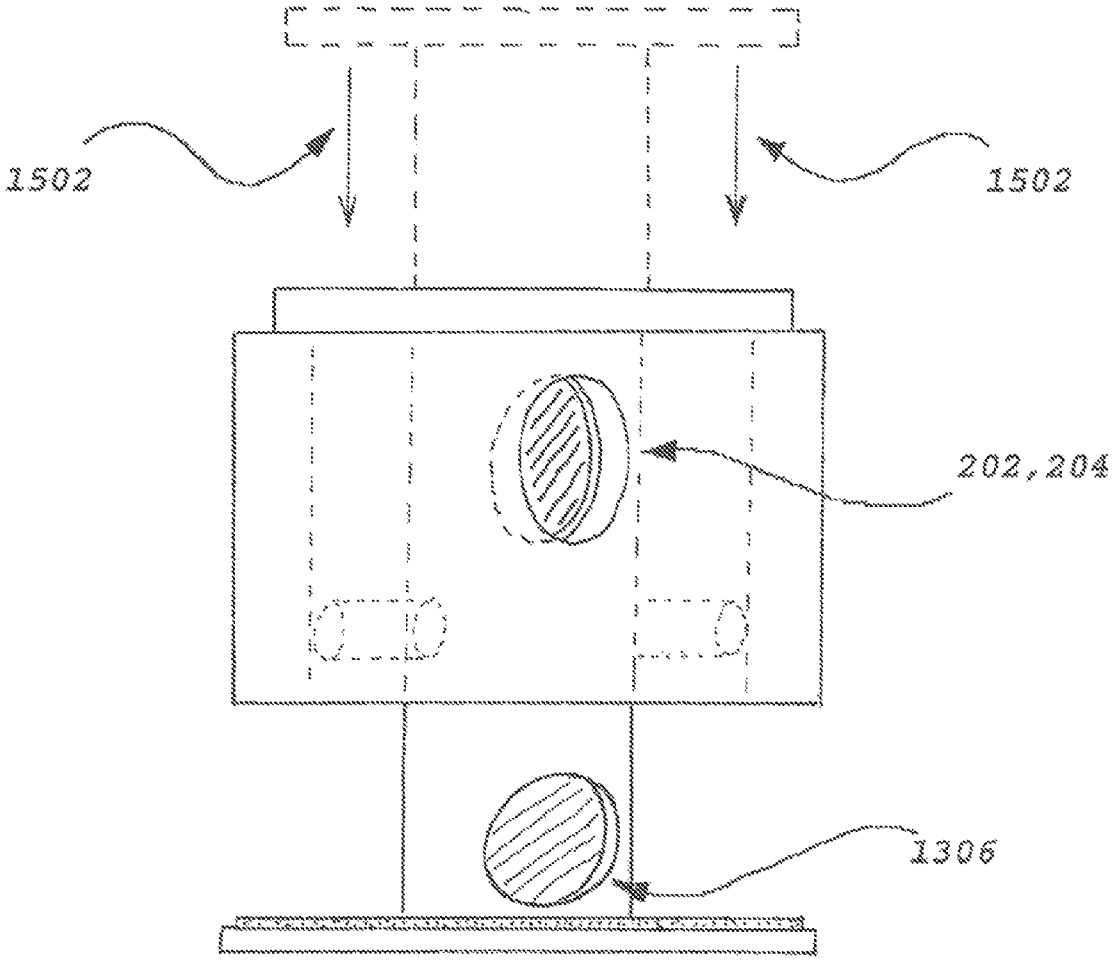
FIG. 15 is a front view of an octave register key having engagement portions and configured in accordance with further embodiments of the technology.

FIG. 15 shows a side view of an embodiment of the octave/register key in which the core comprises a pair of pegs that engage notches in the sleeve sidewall, to promote alignment of the core opening and the sleeve sidewall aperture(s) by preventing rotation of the core within the sleeve, and a base plate that is capable of forming an airtight seal with at least one of (i) a body portion of the musical wind instrument, and (ii) a tone hole pad of a tone hole key to which the octave/register key is affixed; arrows 1502 indicate direction of movement of the core upon actuation.

Figure 16:
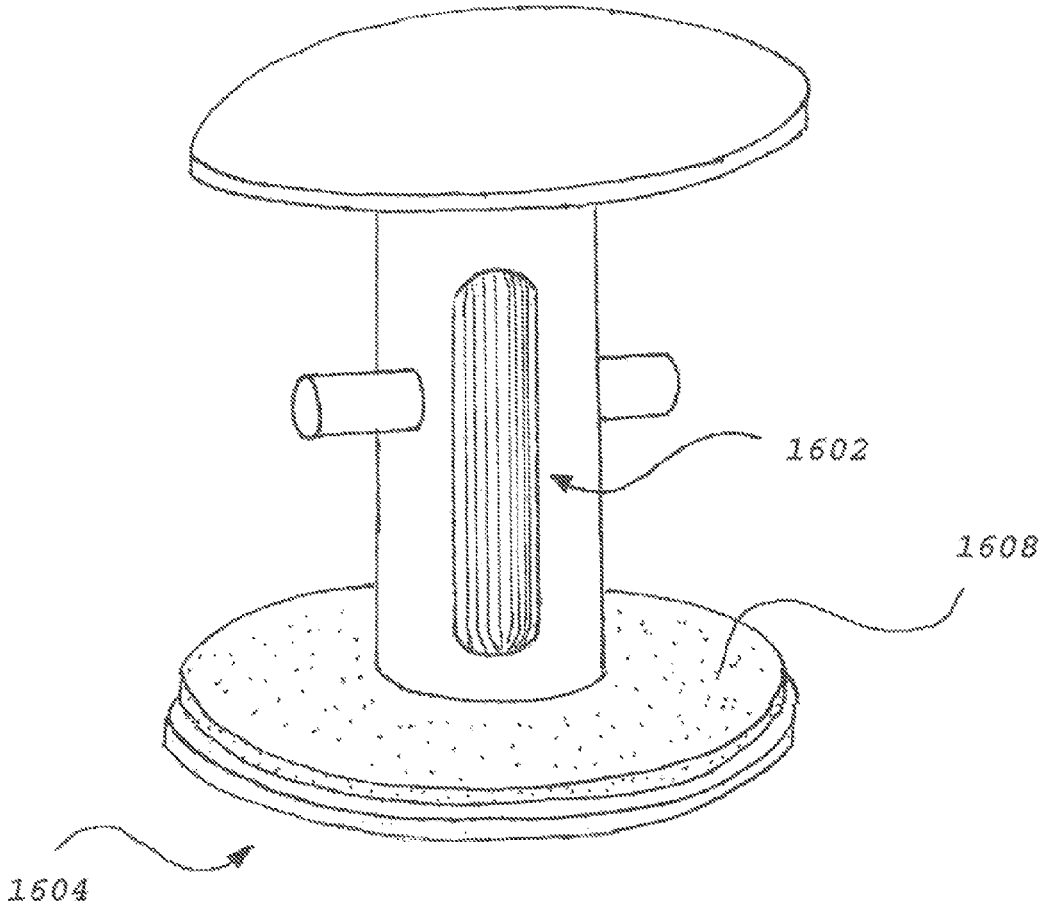
FIG. 16 is a front isometric view of a core portion of an octave/register key configured in accordance with embodiments of the technology.
Figure 17:
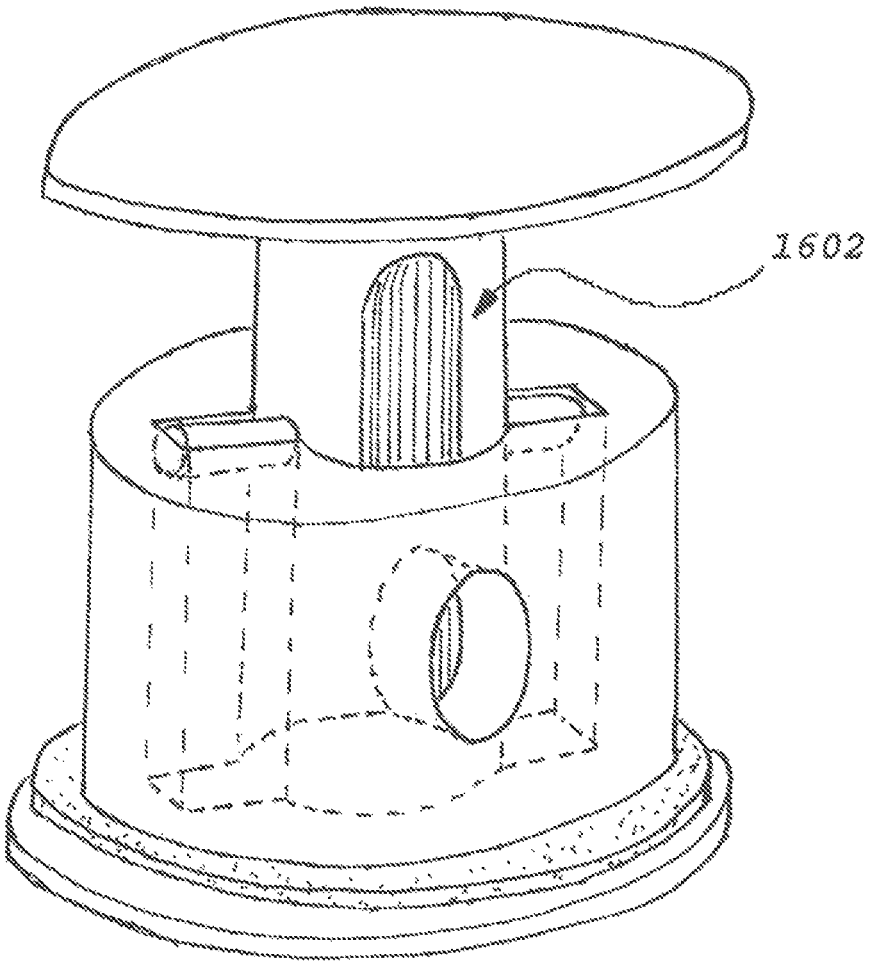
FIG. 17 is a front isometric view of an octave register key having engagement portions and configured in accordance with embodiments of the technology.

FIG. 16 shows the core in an embodiment of the octave/register key in which the core comprises a pair of pegs that engage notches in the sleeve sidewall, to promote alignment of the core opening with the sleeve sidewall apertures by preventing rotation of the core within the sleeve. The core also comprises a base plate 1604 that is capable of forming an airtight seal with at least one of (i) a body portion of the musical wind instrument, and (ii) atone hole pad of a tone hole key to which the octave/register key is affixed. The core opening 1602 is sufficiently elongated to provide both fluid communication with the interior of the musical instrument and alignment with the sleeve sidewall aperture. The core also comprises abuse plate 1604 having a seal 1608 that is capable of forming an airtight seal with at least one of (i) a body portion of the musical wind instrument, and (ii) a tone hole pad of a tone hole key to which the octave/register key is affixed. The seal 1608 is formed of resilient sealing material that is adheringly affixed to the base plate of the core and that facilitates formation by the base plate of an airtight seal. FIG. 17 shows an embodiment of the octave/register key in which the core comprises a pair of pegs that engage notches in the sleeve chamber sidewall, to promote alignment of the core opening(s) and sleeve sidewall aperture(s) by preventing rotation of the core within the sleeve, and a base plate that is capable of forming an airtight seal with at least one of (i) a body portion of the musical wind instrument, and (ii) a tone hole pad of a tone hole key to which the octave/register key is affixed. The core opening is sufficiently elongated to provide both fluid communication with the interior of the musical instrument and alignment with the sleeve sidewall aperture, at the same time, when the octave/register key is actuated. This embodiment allows air pressure to escape from the column of air inside the musical instrument by passing directly into the core opening without there being an open end at the portion of the core proximal to the musical wind instrument air column.

Figure 18:
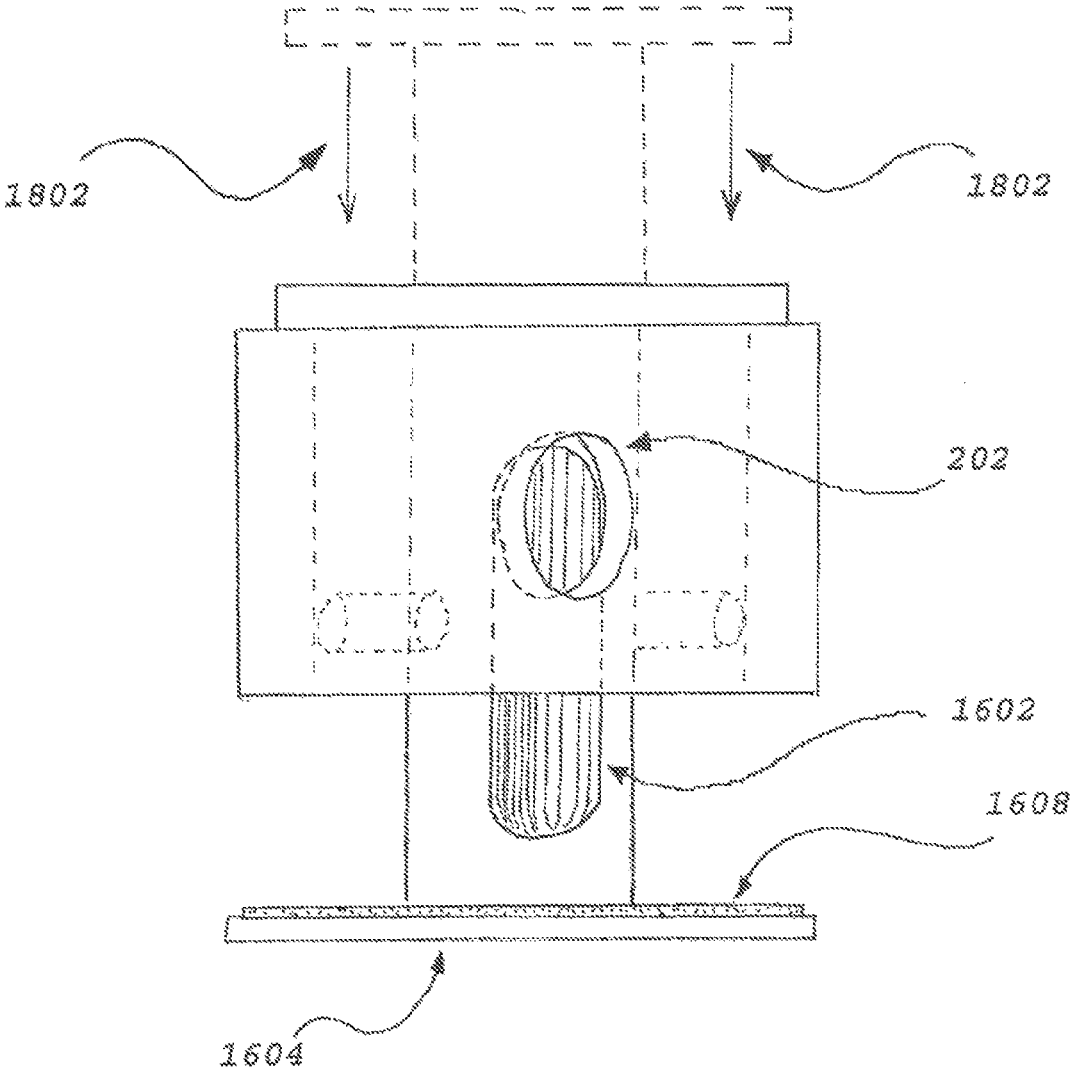
FIG. 18 is a front view of an octave register key having engagement portions and configured in accordance with further embodiments of the technology.

FIG. 18 depicts actuation of an embodiment of the octave/register key in which the core comprises a pair of pegs that engage notches in the sleeve chamber sidewall, to promote alignment of the core opening(s) and sleeve sidewall aperture (s) by preventing rotation of the core within the sleeve, and a base plate that is capable of forming an airtight seal with at least one of (i) a body portion of the musical wind instrument, and (ii) a tone hole pad of a tone hole key to which the octave/register key is affixed. The core opening is sufficiently elongated to provide both fluid communication with the interior of the musical instrument and alignment with the sleeve sidewall aperture, at the same time, when the octave/register key is actuated. This embodiment allows air pressure to escape from the column of air inside the musical instrument by passing directly into the core opening without there being an open end at the portion of the core proximal to the musical wind instrument air column; arrows 1802 indicate direction of movement of the core upon actuation.

Figure 19:
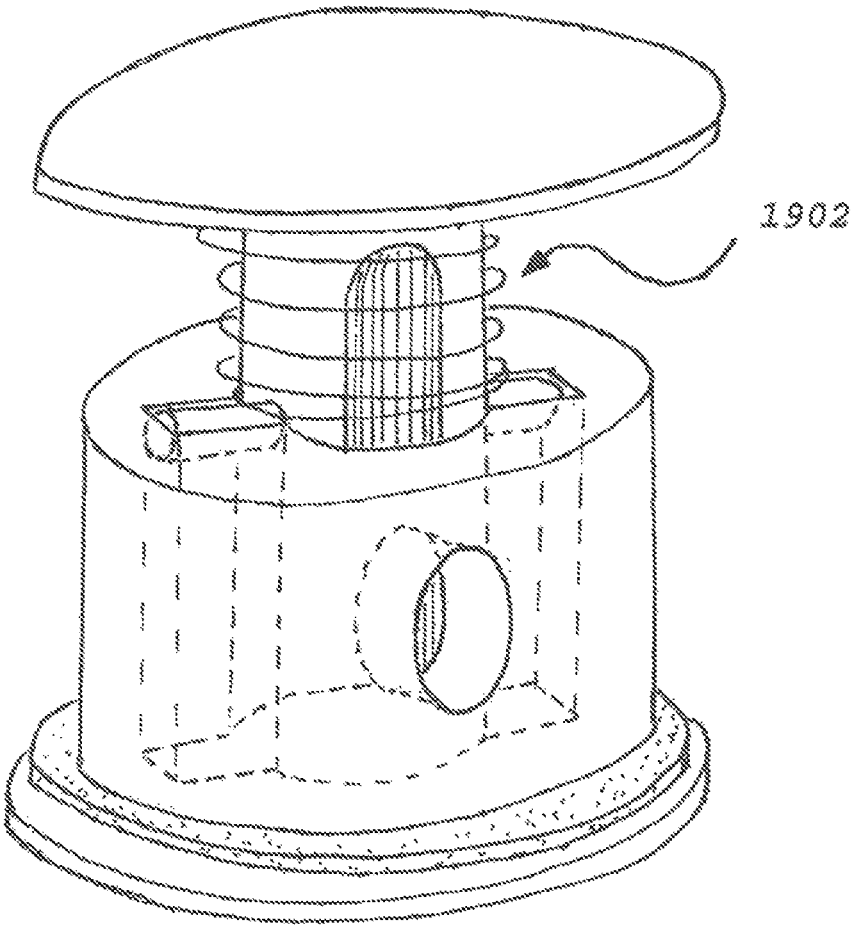
FIG. 19 is a front isometric view of an octave register key having engagement portions and an actuation reversal element and configured in accordance with still further embodiments of the technology.

FIG. 19 shows an embodiment of the octave/register key in which the core comprises a pair of pegs that engage notches in the sleeve chamber sidewall, to promote alignment of the core opening(s) and sleeve sidewall aperture(s) by preventing rotation of the core within the sleeve, and a base plate that is capable of forming an airtight seal with at least one of (i) a body portion of the musical wind instrument, and (ii) a tone hole pad of a tone hole key to which the octave/register key is affixed. The core opening is sufficiently elongated to provide both fluid communication with the interior of the musical instrument and alignment with the sleeve sidewall aperture, at the same time, when the octave/register key is actuated. An actuation-reversal element is present in the form of a helical spring 1902 coiled around the exterior surface of the core and positioned to engagingly resist actuation by exerting spring force against the sleeve sidewall.

Figure 20:
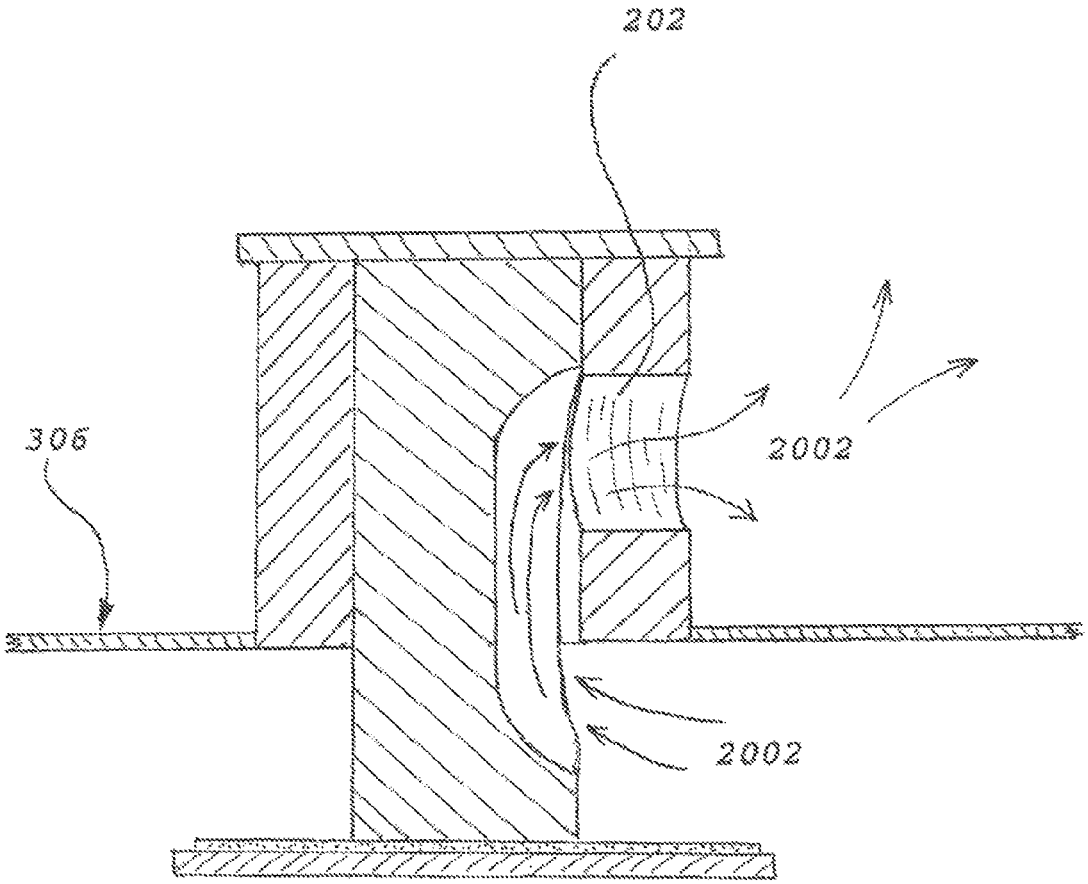
FIG. 20 is a cross-sectional side view of an octave register key in an actuated position and configured in accordance with embodiments of the technology.

FIG. 20 shows an exemplary embodiment of the octave/register key in its actuated position, where a portion of the elongated core opening and the sleeve sidewall aperture are aligned, such that air pressure can escape from the interior of the musical instrument into the elongated core opening, and thence through the aligned portion of the core opening and sleeve sidewall aperture, to the exterior surface of the sleeve and to the exterior ambient; arrows 2002 indicate direction of air flow upon actuation.

Figure 21A:
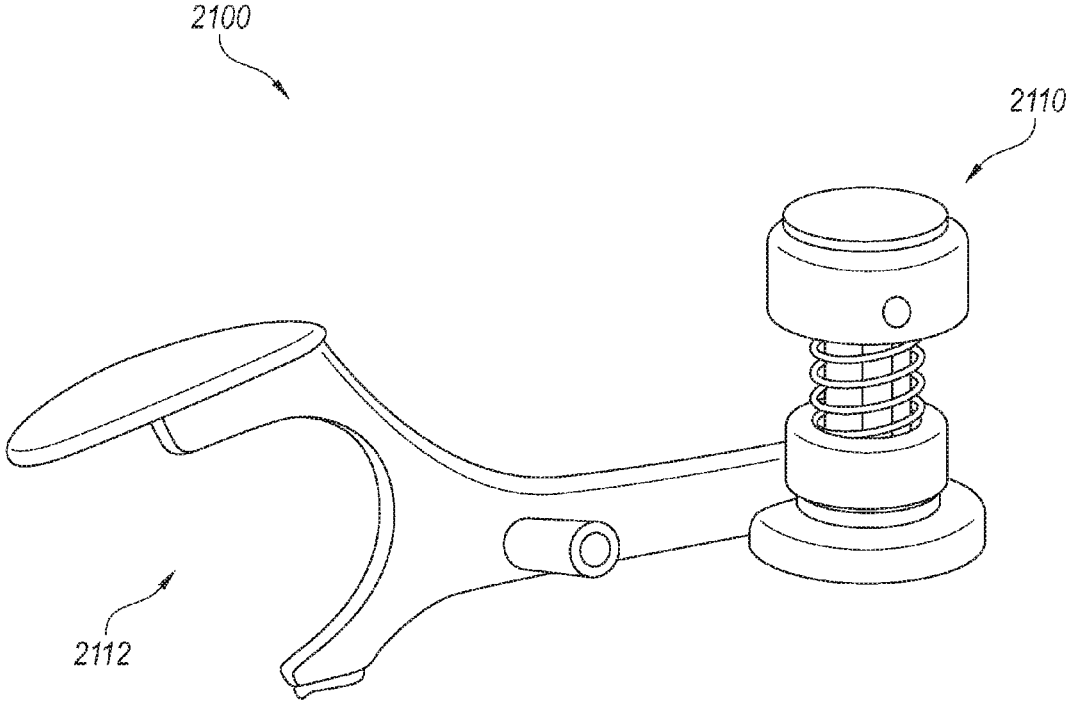
FIG. 21A is a side isometric view of an octave/register key assembly in a resting position and coupled to a tone hole key/lever for a woodwind instrument in accordance with embodiments of the technology.
Figure 21B:
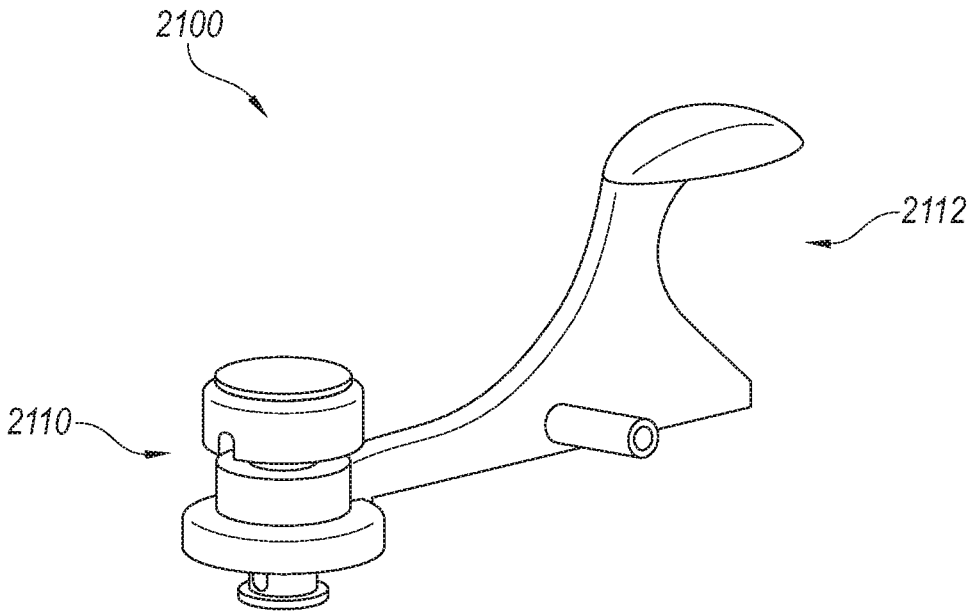
FIG. 21B is a side isometric view of the octave/register key assembly of FIG. 21A in an actuated position and configured in accordance with embodiments of the technology.
Figure 21C:
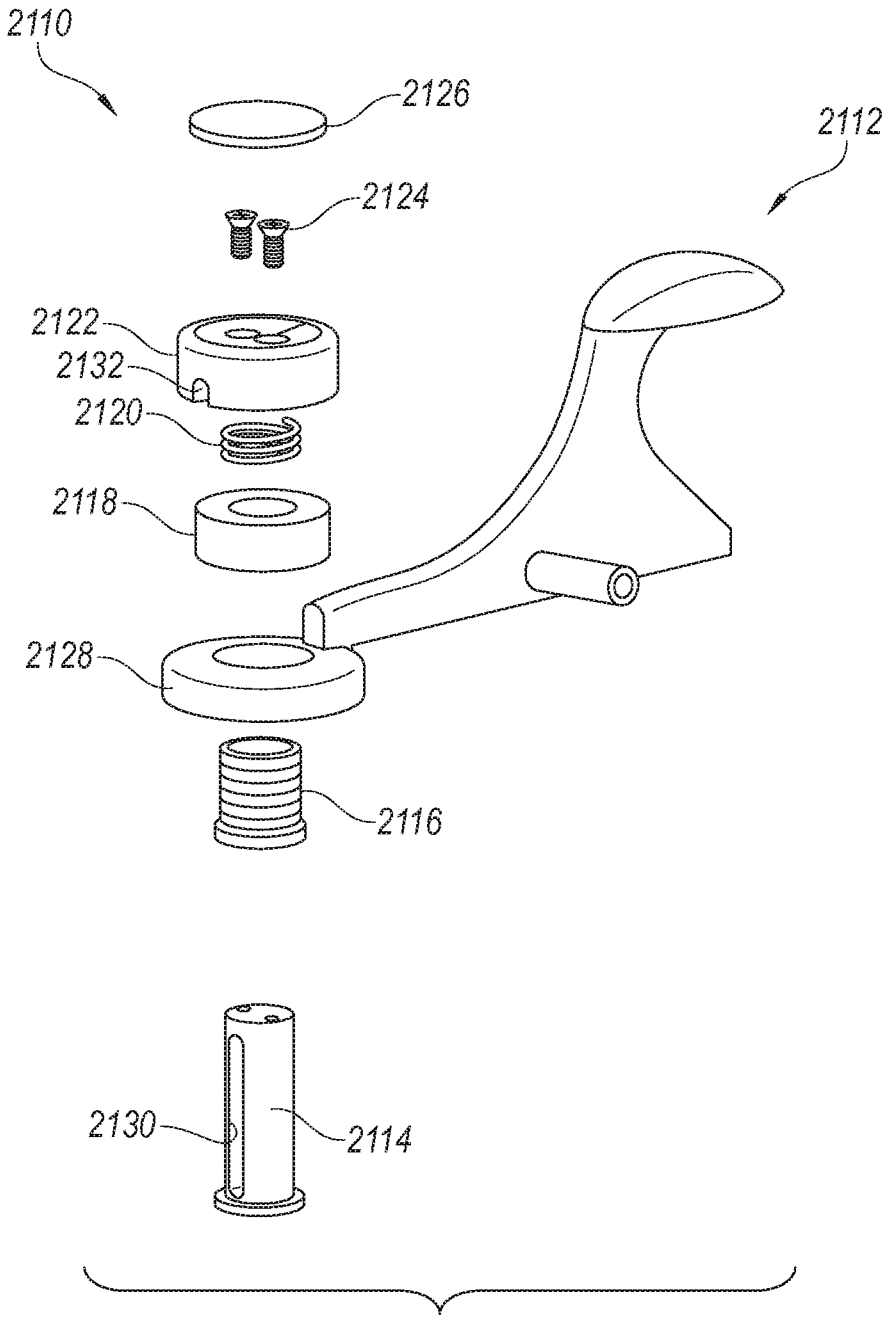
FIG. 21C is an exploded isometric view of the octave/register key assembly of FIG. 21A configured in accordance with embodiments of the technology.

FIG. 21A is a side isometric view of an octave/register key assembly 2100 in a resting position and coupled to a tone hole key/lever 2112 for a woodwind instrument in accordance with embodiments of the disclosed technology. FIG. 21B is a side isometric view of the octave/register key assembly 2100 in an actuated position and configured in accordance with embodiments of the technology. FIG. 21C is an exploded isometric view of the octave/register key assembly 2100. Referring to FIGS. 21A-21C together, the assembly 2100 includes an octave/register key 2110 coupled to atone hole cover 2128 portion of the tone hole key/lever 2112. In some embodiments, the tone hole key/lever 2112 is generally similar to the tone hole key/lever 402 discussed above with reference to FIG. 4A. In particular embodiments, the assembly 2100 can be used with a saxophone, but in other embodiments the assembly 2100 can be used with any other type of musical wind instrument described herein.

The octave/register key 2110 includes a core 2114 nested within a framework comprising the tone hole cover 2128, a sleeve 2116, and a threaded portion 2118 configured to interface with the sleeve 2116. In some embodiments, the threaded portion 2118 comprises a nut or washer. The interfacing threaded portion 2118 and sleeve 2116 can ease affixation of the octave/register key 2110 to an instrument, such as by a simple threading interface, without the need of solder or adhesive. More specifically, a collar portion of the sleeve 2116 can retain the sleeve 2116 in the instrument's air column while an elongated portion of the sleeve 2116 can protrude through the instrument's tone hole cover 2128. The elongated portion of the sleeve 2116 and threaded portion 2118 can have complementary threading, and the two components can be attached accordingly, thereby sandwiching the tone hole cover 2128. The threaded portion 2118 can thus act as an extension of the sleeve 2116. In some embodiments, the sleeve 2116 and threaded portion 2118 are removably coupled. In further embodiments, friction fit, solder, epoxy, or other fastener can be used to couple or otherwise affix the octave/register key 2110 to the tone hole cover 2128. In particular embodiments, the threaded portion 2118 is absent and the sleeve 2116 alone can provide a framework for the core 2114 and can be coupled to the tone hole cover 2128 with another fastener, such as adhesive. In further embodiments, the tone hole key/lever 2112 can be coupled to another portion of the octave/register key 2110 or may not be coupled to the octave/register key 2110 at all. While in several embodiments the core 2114 is positioned in a bore through the tone hole cover 2128, in other embodiments the octave/register key 2110 can be affixed to a hole that is drilled into the surface of the body of a woodwind instrument, such as described above with reference to FIGS. 3A and 3B. Further, the octave/register key 2110 can be integral to newly manufactured instruments or can be retrofitted onto previously-existing instruments.

In several embodiments, the core 2114 includes a sidewall aperture 2130 extending at least a portion of the length of the core 2114. The illustrated sidewall aperture 2130 is elongated along the length of the core 2114 and extends a majority of the length of the core 2114. The sidewall aperture 2130 can be other sizes in other embodiments and need not necessarily be elongated. In further embodiments, the core 2114 additionally or alternately can include a base aperture (generally similar to the base aperture shown and discussed with reference to FIGS. 1A and 6). In other embodiments, the core 2114 includes a generally solid base plate that is capable of forming an airtight seal with at least one of (i) a body portion of the musical wind instrument, and (ii) a tone hole pad of a tone hole key to which the octave/register key is affixed. In still further embodiments, the sidewall aperture 2130 extends the entire length of the core 2114, a greater or lesser portion of the circumference of the core 2114, and/or there can be more than one aperture. As will be discussed in further detail below, the sidewall aperture 2130 can provide a fluid communication pathway between the air column inside the musical instrument and the exterior ambient air. When actuated, the core 2114 can thus function as an octave/register vent in the manner described above with reference to FIGS. 1A-20.

The core 2114 is capped by a key cap or an actuator 2122 having a tactile interface 2126 attached thereto. In some embodiments, the tactile interface 2126 is coupled to the actuator 2122 by adhesive and the actuator 2122 is coupled to the core 2114 by one or more fasteners 2124 such as adhesive or one or more screws. In further embodiments, the tactile interface 2126, actuator 2122, and/or core 2114 are integrally formed. In some embodiments, the actuator 2122 and core 2114 are fixedly coupled so as to prevent or inhibit rotational motion between these features. The tactile interface 2126 can be a smooth and/or indented surface sized and suitable for easy user actuation. The tactile interface 2126 can be made of, for example, rubber, plastic, mother of pearl and/or another suitable tactile material. In further embodiments, the actuator 2122 itself may be suitable for direct user actuation and an additional tactile component need not be attached thereto.

In some embodiments, the actuator 2122 includes one or more actuator sidewall apertures 2132. The actuator sidewall aperture 2132 can be aligned with the sidewall aperture 2130 on the core 2114 and provide fluid communication between air in the core 2114 and ambient air. In some embodiments, the actuator sidewall aperture 2132 and core sidewall aperture 2130 maintain alignment via the fasteners 2124. In further embodiments, the actuator 2122 can alternately or additionally include other apertures around the circumference of the actuator 2122 or on the top of the actuator 2121. In certain embodiments, the actuator sidewall aperture 2132 can be formed in and/or on the sleeve 2116. In some embodiments, both the actuator 2122 and the sleeve 2116 can include sidewall apertures. In other embodiments, however, neither the actuator 2122 nor the sleeve 2116 includes an aperture.

The octave/register key 2110 can further include an actuation reversal feature 2120, such as a spring. The actuation reversal feature 2120 can urge the octave/register key to the resting position shown in FIG. 21A after the key 2110 has been actuated. In the illustrated embodiment, the actuation reversal feature 2120 is positioned around the core 2114 and longitudinally between the actuator 2122 and the tone hole cover 2128 and/or the threaded portion 2118. In other embodiments, the actuation reversal feature 2120 can be positioned anywhere on the assembly 2100 and/or instrument where the actuation reversal feature 2120 can urge the octave/register key 2110 to return to a resting position. In various embodiments, and depending on the desired operational properties of the octave/register key and the musical instrument, the "resting" position may indicate either an open fluid pathway or a closed fluid pathway between the ambient air and the instrument wind column. In further embodiments, any other actuation reversal component (e.g., magnets) can be used or the actuation reversal feature 2120 can be absent altogether.

In operation, the octave/register key 2110 can be actuated by pushing down on the actuator 2122 (e.g., pushing down on the tactile interface 2126 of the actuator 2122). This motion counteracts (i.e., compresses) the actuation reversal feature 2120 and pushes the core 2114 into the air column of the musical instrument. The sidewall aperture 2130 on the core 2114 is exposed to the interior of the musical instrument and gains fluid communication with the air column inside the musical instrument. Air from the air column in the musical instrument is fluidly released through the sidewall aperture 2130 and into the core 2114. The air can then fluidly communicate with ambient air outside the musical instrument. The air can pass directly from the core 2114 to ambient air if a portion of the sidewall aperture 2130 is exposed to ambient air outside of the instrument. For example, air can exit the core 2114 through the sidewall aperture 2130 through the partially compressed actuation reversal feature 2120. Otherwise, if the core 2114 (and sidewall aperture 2130) is entirely depressed into the instrument, or the sidewall aperture 2130 is substantially blocked by the compressed actuation reversal feature 2120, the air in the core 2114 can pass from the core 2114 to the actuator sidewall aperture 2132 and then to ambient air. The air from the musical instrument air column thus can find at least one path of fluid communication with the ambient air regardless of the degree to which the octave/register key 2110 is actuated.

Certain embodiments contemplate an octave/register key for affixing to a musical wind instrument in which an air column is formed, comprising a sleeve having (i) at least one open end, (ii) a sidewall separating an interior chamber from an exterior surface, and (iii) at least one sleeve sidewall aperture; and a core that is coaxially and slidably disposed within the interior chamber of the sleeve. The core has an opening and is capable of reversibly sliding within the interior chamber of the sleeve, to establish fluid communication, via the opening, between the air column of the musical wind instrument and the sleeve sidewall aperture. It may be preferred in certain embodiments to configure the octave/register key such that fluid communication is established along a path that is substantially coaxial with the sleeve and the core.

In certain such embodiments, this path of fluid communication may be substantially perpendicular to the air column. For example, reversible actuation of the octave/register key to establish fluid communication between the air column of the musical wind instrument and the sleeve sidewall aperture may be effected by the user, simply by applying pressure to one end of the core and/or to the closed end of the sleeve (e.g., by depressing a finger on the octave/register key while playing the instrument), causing the core to slide relative to the sleeve. It will be understood that a path of fluid communication between the musical wind instrument air column and the sleeve sidewall aperture that is "substantially perpendicular" to the air column may not be exactly perpendicular. Such a path as air may travel in the course of venting the air column, from within the musical wind instrument via the core opening to the sleeve sidewall aperture, may depart from an exactly perpendicular angle (i.e., 90°), along all or one or more portions of the path traveled, by up to 5, 10, 15, 20, 25, 30, 35, 40, 45 or more degrees, as may conveniently accommodate placement of the herein described octave/register key at an effective position on the instrument, such as a position that is comfortable for the user and that permits achieving desired alterations in musical pitch and tone quality.

The core opening fluidly communicates with the interior of the musical wind instrument (e.g., with an air column therein) in certain embodiments regardless of whether or not the octave/register key is actuated, and the core opening can be configured in such a way that actuation brings the core opening into communicative alignment with the sleeve sidewall aperture (e.g., by sliding of the core within the sleeve) but does not abrogate communication from the wind instrument interior to the core opening. Hence, actuation permits fluid communication of air from within the instrument to the exterior, via the herein described octave/register key. For example, and as illustrated in the drawings, such communication may be achieved by providing the opening as an elongated depression, gap, channel, slot, hole, trough, valley, rut, hollow, trench, chamber, compartment or the like, that is positioned in the core in a manner that can reversibly effect fluid communication between the air column and the sleeve sidewall aperture as a function of whether and to what degree the core is permitted to reversibly slide within the sleeve, such as by actuation. As described herein, such venting of the air column during a musical performance may desirably alter the pitch and tonal properties of the musical note produced by the instrument.

Conversely, certain other embodiments contemplate an octave/register key as described herein in which the core opening fluidly communicates with the exterior of the musical wind instrument (e.g., via the sleeve sidewall aperture) regardless of whether or not the octave/register key is actuated, and the core opening is configured in such a way that actuation (e.g., by sliding of the core within the sleeve) brings the core opening into communication with the wind instrument interior (e.g., the air column) but does not abrogate communicative alignment with the sleeve sidewall aperture, by which fluid communication with the exterior environment is achieved. Hence, in these and similar embodiments actuation also permits fluid communication of air from within the instrument to the exterior, via the herein described octave/register key.

Optionally and in certain embodiments, air cannot pass through the opening of the core to the exterior surface of the sleeve when the opening of the core is not aligned to be in fluid communication with the sleeve sidewall aperture, which it will be understood may in certain configurations be the case when only a portion of the opening aligns with the sleeve sidewall aperture, as may be sufficient to permit airflow and hence fluid communication. According to certain related embodiments the core comprises a member that is capable of forming an airtight seal with one or both of a body portion of the musical wind instrument and a tone hole pad of a tone hole key to which the octave/register key is operably affixed. Such embodiments include, but need not be limited to, those in which the core has a base plate that comprises or to which can be affixed the airtight seal. Persons familiar with the relevant art will, in view of the disclosure herein, recognize materials, methodologies and configurations by which such an airtight seal may be made. Non-limiting examples of seals may include those that comprise rubber, silicone, cork, leather, wax, ceramic, metal, glass, plastic and synthetic polymers, and any other sealing material as can form a substantially airtight seal under the conditions of temperature, humidity, and pressure typically encountered in the musical wind instrument operation. Certain embodiments expressly contemplate an airtight seal that comprises a resilient material that is non-liquid at 30° C. to 40° C.

As described in greater detail elsewhere herein, certain embodiments of the present octave/register key provide advantages that derive from the fact that the octave/register key is capable of being operably affixed to a tone hole key that is present on the musical wind instrument, for instance, such that both the tone hole key and the octave/register key can be actuated with a single finger. As will be apparent based on the disclosure herein, by providing these and other features, the present embodiments offer useful advantages including versatility, ease of installation, ease of actuation and desirable control of musical pitch and intonation. According to certain other embodiments there is provided a pushbutton octave/register key for a musical wind instrument, comprising at least two coaxially disposed chambers. Each chamber has (a) a sidewall separating an interior compartment from an exterior surface; and (b) at least one open end, a first of the chambers comprising a sleeve and a second of the chambers fitting slidably within said sleeve of the first chamber, wherein (i) the sidewall of the first chamber comprises one or a plurality of first chamber sidewall apertures, (ii) the sidewall of the second chamber comprises one or a plurality of second chamber sidewall apertures, and (iii) the first and second chamber sidewall apertures are positioned in their respective sidewalls such that the second chamber can reversibly slide within the first chamber to align the first chamber sidewall apertures with the second chamber sidewall apertures to bring the interior compartment of the second chamber into fluid communication with the exterior surface of the first chamber.

According to certain embodiments as described herein, the second chamber sidewall aperture is sufficiently elongated such that, upon actuation, the second chamber sidewall aperture reaches sufficiently far enough into the interior of the musical instrument that it gains fluid communication with the air column inside the musical instrument, and air is allowed to pass fluidly through said second chamber sidewall aperture and upon entering the interior of the second chamber, can continue to pass through the first and second chamber sidewall apertures when the first and second chamber sidewall apertures are aligned.

Accordingly and in certain illustrative and non-limiting embodiments as provided herein, there is provided a pushbutton octave/register key for musical wind instruments that combines a vent and a mechanism to open and close it. The octave/register key device may in some embodiments, but need not according to other embodiments, comprise a retracting pipe. The herein described octave/register key can, unlike existing register keys, advantageously be mounted anywhere on the body of a musical wind instrument and/or onto any existing tone hole key of the instrument. Thus, for instance, the octave/register key described herein may replace and/or supplement customary octave vents and/or the register keys and pads that are normally used to cover and uncover such vents. Extra octave/register vents may be added at various locations on a musical wind instrument without requiring additional keys, levers and pads. In an exemplary embodiment there may thus be provided a tubular air vent combined with a push-button, forming a single mechanism that can be installed anywhere on a musical wind instrument (e.g., FIGS. 1 and 3). In this and related embodiments including several exemplary embodiments described herein, including in the figures, octave/register keys are described that comprise substantially cylindrical cores and sleeves as provided herein, or substantially cylindrical first and second coaxially disposed chambers as described herein, but the disclosed technology is not intended to be so limited and contemplates any number of shapes, sizes, designs and configurations in which the encompassed octave/register key may be obtained.

The herein described octave/register key is self-contained, permitting rapid and easy installation on a musical wind instrument of a new octave/register vent by an instrument maker or repairperson. Certain contemplated embodiments therefore envision installation of a new octave/register vent on a musical wind instrument without impeding other keys that may already be on or part of the wind instrument. For instance, when a new octave/register vent is desired on a wind instrument, a small hole may be carefully drilled at a predetermined place on the instrument according to criteria known in the art and described herein. Then, for example, using solder or another fixative or adhesive or alternatively some other attachment means as will be known to those familiar with the relevant art, the octave/register key can be attached as a self-contained unit at the point of the drilled hole(s), providing an easy method for opening and closing the vent at the will of the musical performer. A research article published by the inventor in the professional trade journal "The Saxophone Journal" (M. S. Brockman, The Saxophone Journal, Volume 33, Number 4, March/April 2009) explains the general concept of making such calculations. Persons skilled in the art will appreciate that for any number of musical wind instruments, determination of the physical dimensions and knowledge of the materials from which the instrument is fabricated will permit determination of the locations at which one or more vents may be desirably introduced, and the dimensions of such vents, in order to achieve disruption of the vibration of an established air column that produces a fundamental pitch as a function of the length of the air column, so as to remove the fundamental pitch from the sound produced by the air column. See, e.g., Benade, Arthur H., Horns Strings and Harmony (1960 Educational Service, Inc., p. 225), 1992 Dover Publications, Mineola, N.Y. Benade's subsequent textbook, Fundamentals of Musical Acoustics (1976 Oxford University Press, p. 458) provides specific formulas for the calculation of octave vent placement and size for woodwind instruments.

Certain exemplary octave/register keys such as those shown in the Drawings include those that may be constructed from two small segments of metal tubing, plus a metal spring, which is included as an actuation-reversal element that causes the core opening and the sleeve sidewall aperture (or the inner and outer chamber sidewall apertures) to return to a non-aligned configuration following actuation, e.g., the octave/register key reverts to relative positioning of the core and sleeve (or of the inner and outer chambers) whereby the wind instrument air column and the exterior environment are no longer in fluid communication after the user releases the actuator. Any of a number of recognized actuation-reversal elements may be included in these and related embodiments, where the actuation-reversal element comprises a device, element, modification, feature or the like that causes the sleeve and the core (or in certain embodiments as described herein, the first and second chambers) to return to their respective pre-actuation positions upon release of the actuator, thereby disrupting fluid communication from the air column to the sleeve exterior. Non-limiting examples of actuation-reversal elements include springs, elastic closures such as rubber bands, O-rings, flexible, resilient or viscoelastic fittings, seals or the like, and magnets (including in certain embodiments a pair of opposed magnets such as two magnets affixed to the device in such a way that natural like-pole repulsive forces reverse the effect of actuation once the user releases pressure from the actuator). The actuator may be a conveniently accessed surface on the octave/register key, for instance, one on which the user can press while playing the wind instrument without having dramatically to change hand position on the instrument, such as a button affixed to an end of the core or to another surface that can be pressingly engaged by the user while playing the musical wind instrument, so as to effect sliding of the core relative to the sleeve. In certain embodiments actuation can be achieved by application of pressure to the actuator using a single finger.

Accordingly and as described herein, the octave/register key may be applied to a musical wind instrument by physical attachment onto the body of a wind instrument (e.g., FIG. 3), and additionally or alternatively, by placement in operable affixation on top of or through an existing tone hole key that is covering a normal tone hole on the instrument (e.g., FIG. 4). Once a small hole is drilled into the instrument or one of its tone hole keys, the herein described octave/register key acts, upon actuation, as a controlled valve that allows a small amount of air to escape from the air column that is formed inside the instrument when a pitch is produced as a fundamental pitch plus its harmonic overtone series, thereby disrupting vibration of the air column and removing the fundamental (and in some cases other harmonic) frequencies.

An octave/register key as described herein that is operably affixed to a tone hole key includes any herein disclosed octave/register key that is mounted on the musical wind instrument by attachment to a tone hole key, e.g., a moving key pad holder or other component that is not itself the principal body of the wind instrument in which the air column is formed during pitch production, and that upon actuation to establish fluid communication between the air column and the exterior surface of the sleeve (or outer chamber) via alignment of the core opening (or second chamber sidewall aperture) and the sleeve sidewall aperture (or first chamber sidewall aperture), results in removal of the fundamental pitch and optionally additional frequencies, to result in alteration of the pitch that is produced by the wind instrument to obtain a pitch that is higher by at least one octave, relative to the fundamental. Typically, actuation is effected when the user presses on an end of the octave/register key and/or on a surface mounted thereupon such as a button, lever, rod, bar or other suitable surface, such that both the tone hole key and the octave/register key can be actuated with a single finger. As also described herein, in certain such embodiments fluid communication between the air column and the sleeve sidewall aperture is established, during actuation of the octave/register key, along a path that is substantially coaxial with the sleeve and the core, and in certain embodiments the path is substantially perpendicular to the air column.

Hence in certain illustrative and non-limiting embodiments, the sleeve may comprise the wider of two slidably nested concentric, coaxial tubes and may be affixed to the outside of the musical wind instrument's body, or onto one of the instrument's tone hole keys, directly over a newly drilled octave/register vent. The sleeve may be affixed so that it extends substantially perpendicularly away from the instrument (e.g., FIG. 5). Depending on the manner by which the sleeve is securely, and preferably in an airtight manner, affixed to the musical wind instrument, the sleeve may but need not extend inside the instrument. The narrower and typically longer tube (hereafter referred to as the "core") is inserted inside the wider sleeve, and is free to slide up and down along the length of the sleeve. In certain typical applications, the core may extend by several millimeters through the drilled hole (e.g., FIG. 6), and into the air column that is formed inside the musical instrument, for example, during performance. When extended, the core draws off pressure (for instance, by passage of air through the core opening to the exterior ambient via the sleeve sidewall aperture when the key is actuated) from the air column inside the musical instrument, so that it functions as an octave/register vent. When not in use, the core retracts back inside the sleeve, and does not extend into the air column of the instrument.

Application to a Tone Hole Key

When the octave/register key is applied to a tone hole key, it becomes an octave/register vent in the tone hole key itself. This makes it possible to continue using that tone hole key to produce its normal pitch, and also to have an octave/register vent that opens in substantially the same position on the air column as the existing tone hole key (e.g., FIGS. 4, 7).

Application of the octave/register key can be to a tone hole key that is normally closed when at rest or not in use, or to one that is normally open when not in use. When applied to a tone hole key that is normally closed at rest, the musical performer can simply press the herein described octave/register key to open an octave/register vent at that position (i.e., the location of the tone hole key) along the body of the musical wind instrument. When applied to a tone hole key that is normally open when at rest, the musical performer first closes the tone hole key, and then also engages the herein described octave/register key in order to open an octave/register vent at that position on the instrument. Thus, at the discretion of the instrument owner or user or instrument manufacturer or repairperson, the octave/register key can be added onto any tone hole key, regardless of whether its resting position is normally open or closed.

A tone hole key normally includes a round disk of flexible or resilient material such a disk that comprises leather, plastic, rubber, metal, silicone or cork or other suitable material, that is affixed to the key (hereafter referred to as a "tone hole key pad"). When the key is closed, the tone hole key pad creates a seal that prevents air from escaping out of the tone hole. When an octave/register key as described herein is mounted onto a tone hole key, the hole that is drilled into the key also extends through the tone hole key pad. This manner of modifying the tone hole key and the key pad allows the core of the octave/register key to pass through the key and through the tone hole key pad, for instance, when it extends into the air column of the instrument upon actuation.

Application to the Body of an Instrument

The octave/register key can also be mounted directly onto the body of a musical wind instrument (e.g., the principal structural component in which the air column is formed to produce sound, typically an elongated tube of variable dimensions including diameter that may vary along the length of the tube and cross-section that may vary in shape along the length of the tube, which may commonly be made of metal, wood, plastic, resin, glass, Plexiglas, ceramic or other materials). This can be done at any point along the body of the instrument, so long as doing so will not impede the functionality of the instrument including the movement of other parts on the instrument. As with the application to a tone hole key (described supra), the wider (e.g., having a greater diameter in cross-section) of the two slidably disposed coaxial components (e.g., the sleeve) of the herein described octave/register key may be affixed perpendicularly onto the outside of the musical wind instrument's body, for instance, directly over a newly drilled octave/register vent, (e.g., FIG. 3B). The narrower component (e.g., the core) that is slidably and coaxially disposed inside the sleeve is free to slide back and forth along the length of the sleeve, and can in certain contemplated embodiments extend by an increment of similar dimension to the amount of movement of such component upon actuation, typically of several millimeters for most of the more common musical wind instruments but potentially of greater dimension for instruments having body members with larger dimensions (e.g., wider-bore diameters in which an air column can be formed) into the air column that is inside the musical instrument, with sufficient length to draw pressure from the air column.

Accordingly, in certain contemplated embodiments the exterior surface of the sleeve may be threaded (e.g., using screw-type threads) so that attaching it to the body of the wind instrument, or to a tone hole key, can be effected by screwing the sleeve into a pre-drilled, threaded hole in the instrument body or tone hole key.

Additionally or alternatively, a threaded flange can be used as a base plate, to create a base into which the threads of such an octave/register key sleeve are screwed. The flange can be inserted or affixed into the drilled hole on the body of the wind instrument, or on the tone hole key. In addition to providing ease of installation for the entire octave/register key device, the use of such a threaded sleeve can, for instance, permit exchanging different sizes and/or types of sleeves to achieve different characteristics of behavior, for example, a sleeve with more or fewer sidewall apertures, and/or having larger or smaller sidewall apertures, and/or having apertures disposed in different positions on the sleeve, and/or a sleeve made of different materials.

The button placed on the core for use as an actuator and to which the user can apply pressure, preferably with a single finger, can also be attached using screw threads according to certain embodiments contemplated herein. This feature permits exchanging different sizes and/or types of buttons, and may also permit easy removal of the core from the sleeve, and thus, can allow exchanging different sizes and/or types of cores to achieve different characteristics of behavior (for instance, a core with more or fewer, and/or larger or smaller openings, and/or having openings disposed in different positions on the core, and/or a core made of different materials). As is known to persons familiar with the relevant art, musical wind instruments are typically played by a user who generates sound by applying air pressure through a mouthpiece to create a dynamic air column that resonates with characteristic fundamental and harmonic frequencies within the instrument according to well-known principles, while varying pitch in part through manipulation of a system of keys, buttons, tone holes, tone hole keys, tone hole covers, valves, rods, levers, springs, sliding elements and the like.

For example, some woodwind instruments such as the saxophone) have tone holes that can only be covered using a lever or mechanism large enough to cover the entire hole. Such mechanisms used to cover large tone holes (that is, tone holes too large to cover with a human finger) may be referred to herein as "tone hole keys". Each tone hole on a wind instrument has an area space between the main air column of the instrument and the outer edge of the tone hole. This space may be referred to herein as the "chimney" of the tone hole (FIG. 3A). Accordingly, certain embodiments described herein refer to a "push-button" octave/register key, which will be understood to include any octave/register key device as presented herein that can be actuated through a manual manipulation, including but not limited to applying digital pressure to an actuator such as a button, key, ring, tone hole, tone hole key, hole, lever, rod or any other means for causing first and second chamber sidewall apertures to align as described herein, and that may be present on the herein described device, for example, as a button positioned on or connected to the core as provided herein, or in certain embodiments to the closed end of the second (inner) chamber.

The coaxially disposed chambers each comprise a sidewall separating an interior compartment form an exterior surface, with at least one open end in the sleeve or outer (first) chamber, such that the first or outer chamber comprises a sleeve within which the second chamber slidably fits, e.g., in a manner such that the inner chamber can slide within the outer chamber along the shared axis. The chambers may be of any similar and/or complementary shapes to permit such sliding, which may be regular or irregular shapes including those described herein (see, e.g., Drawings). Accordingly, in certain embodiments the chambers may be cylindrical or may be provided in the form of nesting ducts that in cross-section may be oval, rectangular, triangular, pentagonal, hexagonal, heptagonal, octagonal, trapezoidal, and/or another polygonal or any other regular or irregular shape, and the disclosed technology is not intended to be limited to any particular shape. Certain embodiments, for instance, contemplate first and second chambers that are shaped in a manner that promotes alignment of the first and second chamber sidewall apertures by preventing rotation of the second chamber within the first chamber, which may be achieved by non-limiting example using a design such as that shown in FIGS. 12-19 in which peg members on the core can complementarily engage notch or slot members in the sleeve, or alternatively which may be achieved using any of a number of different shape configurations as will be appreciated by those skilled in the relevant art based upon the disclosure herein. Accordingly, certain exemplary embodiments are presented herein in which the chambers are provided substantially as cylindrical in shape, or as pipes or tubes, or as having complementary engaging notches and pegs, but the disclosed technology is not intended to be limited to these examples and may be practiced using other shapes while still remaining within the presently contemplated embodiments. Similarly, according to the disclosure herein there may be one or a plurality of apertures in the sidewall of the first chamber (first chamber sidewall apertures) and one or a plurality of apertures in the sidewall of the second chamber (second chamber sidewall apertures), which apertures may be provided in any shape that results in desired sonic and harmonic properties as can be achieved readily and without undue experimentation based on the present disclosure. Thus, for example, the sidewall apertures may be round or may be provided in the form of fully or partially aligning windows or openings that in cross-section may be oval, rectangular, triangular, pentagonal, hexagonal, heptagonal, octagonal, trapezoidal, other polygonal or any other regular or irregular shape, and the disclosed technology is not intended to be limited to any particular shape. According to some embodiments the first and second chamber sidewall apertures in a particular octave/register key will be substantially the same in size and shape to promote efficient fluid communication of air from the interior compartment of the inner chamber to the exterior of the outer chamber, but the disclosed technology is not intended to be so limited. For instance, and as also described elsewhere herein including as shown in the Drawings, in certain embodiments the octave/register key may comprise a core having an opening that can reversibly establish fluid communication between the air column of the musical wind instrument and the sleeve sidewall aperture, such as an elongated slot, gouge, trough, valley, depression or the like, that can at least partially align with the sleeve sidewall aperture upon actuation while also being sufficiently elongated to maintain fluid communication with the air column within the wind instrument, such that fluid communication between the air column and the exterior can be established, as may usefully provide venting. As also described elsewhere herein, the second (inner) chamber reversibly slides within the first (outer or sleeve) chamber in a manner that aligns the first and second chamber sidewall apertures, thereby bringing the interior compartment of the second chamber into fluid communication with the exterior surface of the first chamber. In some embodiments, air cannot pass through the second chamber sidewall aperture when the first and second chamber sidewall apertures are not aligned in fluid communication, i.e., an airtight or substantially airtight (e.g., permitting little or no detectable airflow from the interior of the second (inner) chamber to the exterior of the first (outer or sleeve) chamber under typical applied air pressures that occur during musical performance on the instrument) seal may be formed.

The herein disclosed octave/register key may be manufactured out of any suitable material, examples of which include metal (including alloys), wood, plastic, Plexiglas, nylon, glass, ceramic, porcelain, carbon fiber, aluminum, ceramic-coated aluminum, aluminum having a non-ceramic finish or coating, or any other material having mechanical and chemical properties that are compatible with the fabrication, installation and use as a component key in a musical wind instrument as provided herein.

In use, certain non-limiting embodiments contemplate configuring the octave/register key on the musical wind instrument in such a manner as to result in encroachment and interruption of the air column by a portion of the octave/register key upon actuation. According to non-limiting theory, an established air column produces a pitch which comprises a fundamental pitch and one or more of its higher-frequency harmonics (e.g., octave, octave-plus-fifth, etc.) and in such embodiments, the protrusion of a portion of the herein described octave/register key (upon actuation by the user) into the air column that is formed within the body of the wind instrument causes substantial disruption of the vibration of the air column. As a result of such vibration-disruption, and further according to non-limiting theory, the fundamental pitch is removed from among the vibration frequencies present in the air column, and the resulting sound is of a pitch formed by the persistent frequencies, such as the pitch that is one octave higher than the (removed) fundamental, and/or higher harmonics, as may vary as a function of several factors including the position of the octave/register key on the instrument.

Various embodiments contemplate modifying a musical wind instrument as provided herein by the addition of 1, 2, 3, 4, 5, 6, 7, 8, 9, 10, 11, 12 or more of the presently described octave/register keys, which may be positioned at any desired location along the body of a musical wind instrument and/or which may be positioned in one or more tone hole keys as described herein, including by emplacement such that the octave/register key traverses a tone hole key pad and is of sufficient dimension to encroach upon the air column when actuated. Understanding of the length of the air column formed to produce a particular pitch (fundamental plus harmonics including the octave) in a particular musical wind instrument is within the knowledge in the art, such that based on the present disclosure, the skilled person can select one or more appropriate positions on the body and/or on the tone hole keys of an instrument for placement of the herein described octave/register key, readily and without undue experimentation, to achieve the ability to produce one or more harmonics of a fundamental pitch (including the pitch that is one octave higher than the fundamental and also including, optionally, one or more of a pitch that is the musical interval of a twelfth higher than the fundamental, two octaves higher, or any of the various harmonics naturally derived from the vibrations of a musical air column) upon actuation of the octave/register key.

According to certain non-limiting embodiments, when not in use, the core of the herein described octave/register key may retract back inside the sleeve, so that it does not extend into the chimney of a tone hole, or into the air column of the musical instrument. This retraction permits there to be nothing extra extending into the chimney of a tone hole when no octave/register key actuation is desired. According to non-limiting theory, where the internal volume of each tone hole and its chimney may be a matter of careful calculation on the part of each instrument manufacturer, the influence of the introduction of extra solid material into the chimney may alter the internal volume of that chimney, thereby affecting the intonation of that tone hole. Thus, the herein described octave/register key may, in these and related embodiments, be provided in a configuration that does not significantly alter the internal volume of a tone hole's chimney when the octave/register key is not actuated. This feature may be especially useful in situations where the present octave/register key is contemplated for use in conjunction with tone holes already existing on a musical wind instrument, and/or with the keys that are already designed to cover them.

EXAMPLES

Octave/Register Key Construction

Example 1

The octave/register key comprised, according to a non-limiting example, two small segments of tubing, plus a spring (FIG. 8). One tube (the sleeve) was wider in diameter, so that the narrower tube (the core) could fit inside it with just enough tolerance to slide freely back and forth inside the larger tube. A lubricant was applied to the inner surface of the sleeve and/or to the outer surface of the core, to aid in sliding, and to help create an air seal between the moving parts. The sleeve was open on both its ends. The core was closed on one end with a permanently affixed disk or plate that was large enough both to prevent air leakage from one end of the core, and to provide a platform on which the user pressed his/her finger to control the device (this disk is hereinafter referred to as the "button"). For octave/register keys that were affixed to different tone hole keys on an alto saxophone or to the saxophone body, the length of the sleeves was approximately 1.0-3.0 cm, and the sleeve diameters were approximately 0.3-0.7 cm. The lengths of the core tubes were approximately 0.5 cm longer than the sleeve, and core tube diameters were selected to be very slightly smaller than the inner diameter of the respective sleeves into which they were coaxially and slidably positioned.

Example 2

The exact lengths and diameters of the core and sleeve segments may be adjusted for various needs and applications such as other locations or positions on the saxophone, or for use on other instruments. For example, an octave/register key as provided herein that is intended for use on a large wind instrument such as a bass saxophone may employ tubing of larger dimensions than an octave/register key that is designed for a relatively very small musical wind instrument such as a soprano saxophone or a sopranino saxophone. With a longer, narrower core inside a shorter, wider sleeve, the core may be fashioned so that it slides inside the sleeve until a button affixed to one end of the core bumps into the sleeve during actuation. The other end of the core (that is, the end that is not covered by the button) is open. At that open end, there is a lip, raised edge, or flared end (e.g., a "raised edge") that is added during the manufacturing process. This raised edge is outside of the sleeve, and it prevents the open end of the core from sliding completely inside the sleeve (FIGS. 1-2). Thus, the entire core can slide inside the sleeve with the exception of the raised edge of the core. The two ends of the core serve to keep it from sliding completely out of the sleeve, and the two tubes (core and sleeve) are, therefore, connected as a unit.

Both tubes have a single small, round hole (approximately 0.02 cm) drilled into their sides (hereafter referred to as "air escape ports" or "apertures"), creating openings through which air can pass, but only when these air escape ports align. When the air escape ports are not aligned, no air can pass from the inside of the tubes to the outside. However, when the air escape ports are aligned, air is allowed to escape from the inside of the instrument, through the tubes (core and sleeve), and out though their aligned ports or apertures. One or more additional ports or apertures may be drilled into the sides of each tube (core and sleeve), creating more pathways for air to escape. The air escape apertures align when the button on the core is pressed, such that the button bumps up against the sleeve and stops when it can no longer travel in the direction of actuation. Air passes from the inside of the instrument through the core and sleeve and out the small, fully or partially aligned holes of the octave/register key, and may only do so when the button of the core is pressed (actuated) sufficiently to establish fluid communication, from the air column inside the instrument, through the core opening of the octave/register key, to the sleeve sidewall aperture and thence to the exterior ambient.

A helical (or coil) spring is engagingly attached as an actuation-reversal element to the outer surface of the octave/register key, and is used to lightly resist the movement of the core in one direction (FIG. 8). The device is normally held in a "resting position" by the spring, with the core opening and the sleeve sidewall aperture unaligned. Thus, the resting position for the octave/register key in this exemplary embodiment is with the pathway for air closed. Actuating the octave/register key by pressing the button affixed to the core compresses the spring, and at the same time causes the core to slide within the sleeve, so that the core opening and the sleeve sidewall aperture at least partially align with one other in a manner sufficient to establish fluid communication therebetween to permit release of air from the instrument interior to the exterior ambient. Releasing pressure from the button (actuator) allows the spring (actuation-reversal element) to decompress, and thereby slides the octave/register key back to its resting (closed) position.

Example 3

On Apr. 11, 2009, the inventor gave a demonstration of a working example of the disclosed technology as part of his presentation about woodwind acoustics at the 2009 Region One Conference of the North American Saxophone Alliance, held at the University of Idaho (Moscow, Id.). Briefly, a musical performance was rendered on an alto saxophone retrofitted with a plurality of metal octave/register key devices as described herein, having coil springs as actuation-reversal elements, as also described herein, including such devices affixed to tone hole keys and to the body of the saxophone. Facility in achieving upward intervallic leaps of an octave through actuation of the octave/register keys, and in attaining superior intonation of such notes relative to that which could be achieved without actuating the octave/register keys, were noted.

As used herein and in the appended claims, the singular forms "a," "and," and "the" include plural referents unless the context clearly dictates otherwise. Thus, for example, reference to "an aperture" or "the aperture" includes reference to one or more apertures (i.e., a plurality of apertures) and equivalents thereof known to those skilled in the art, and so forth, unless clearly indicated otherwise. Reference throughout this specification to "one embodiment," or "an embodiment," or "in another embodiment," or "in some embodiments" means that a particular referent feature, structure, or characteristic described in connection with the embodiment is included in at least one embodiment. Thus, the appearance of the phrases "in one embodiment," or "in an embodiment," or "in another embodiment" in various places throughout this specification are not necessarily all referring to the same embodiment. Furthermore, the particular features, structures, or characteristics may be combined in any suitable manner in one or more embodiments. Throughout this specification, unless the context requires otherwise, the words "comprise", "comprises" and "comprising" will be understood to imply the inclusion of a stated step or element or group of steps or elements but not the exclusion of any other step or element or group of steps or elements. By "consisting of" is meant including, and limited to, whatever follows the phrase "consisting of." Thus, the phrase "consisting of" indicates that the listed elements are required or mandatory, and that no other elements may be present. By "consisting essentially of is meant including any elements listed after the phrase, and limited to other elements that do not interfere with or contribute to the activity or action specified in the disclosure for the listed elements. Thus, the phrase "consisting essentially of indicates that the listed elements are required or mandatory, but that no other elements are required and may or may not be present depending upon whether or not they affect the activity or action of the listed elements.

The various embodiments described above can be combined to provide further embodiments, All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

I claim:

1. An octave/register key for affixing to a musical wind instrument in which an air column is formed, the octave/register key comprising:

a core having a core aperture therein, wherein the core is reversibly moveable from a first position in which the core aperture is in fluid communication with the air column toward a second position in which the core aperture is out of fluid communication with the air column; and an actuator coupled to the core and movable with the core to adjust a degree to which the core aperture is in fluid communication with the air column.

2. The octave/register key of claim 1 wherein the actuator comprises at least actuator aperture therein, and wherein the actuator aperture is in fluid communication with the core aperture.

3. The octave/register key of claim 2 wherein the actuator aperture and the core aperture are permanently aligned by at least one of fasteners or integral forming.

4. The octave/register key of claim 1 wherein the core includes a sidewall, and wherein the core aperture comprises an elongated aperture in the sidewall.

5. The octave/register key of claim l wherein fluid communication is established along a path that is substantially perpendicular to the air column.

6. The octave/register key of claim 1, further comprising an actuation reversal component in operable communication with the core and the actuator.

7. The octave/register key of claim 6 wherein the actuation reversal component comprises at least one of a spring, a magnet, a pair of opposed magnets, an elastic closure, or a lever.

8. The octave/register key of claim 6 wherein the actuation reversal component is positioned longitudinally between the musical instrument and the actuator are configured to urge the actuator away from the musical instrument.

9. The octave/register key of claim I wherein at least a portion of the octave/register key is made of one or more of metal, metal alloy, wood, plastic, Plexiglas, nylon, glass, ceramic, porcelain, carbon fiber, aluminum, ceramic-coated aluminum, or aluminum having a non-ceramic coating.

10. The octave/register key of claim 1 wherein, when the core is in the second position, the core forms a substantially airtight seal between the air column and ambient air.

11. The octave/register key of claim 1 wherein the musical wind instrument is selected from a woodwind instrument and a brass instrument.

12. The octave/register key of claim 11 wherein the woodwind instrument is selected from a sopranino saxophone, a soprano saxophone, an alto saxophone, a C-melody saxophone, a tenor saxophone, a baritone saxophone, a bass saxophone, a clarinet, a bass clarinet, a flute, a bass flute, double-reed instrument, an oboe, a bassoon, a contrabassoon, an English horn, a recorder, a blockflute, a tarogato, a contrabass saxophone, a crumhorn, a bass oboe, a soprillo saxophone, an alto clarinet, Eb clarinet, a subcontrabass saxophone, a piccolo, and a shawm.

13. The octave/register key of claim 11 wherein the brass instrument is selected from a trumpet, a flugelhorn, a bugle, a trombone, a mellophone, a euphonium, a baritone horn, a tuba, a French horn and a sousaphone.

14. A push-button octave/register key configured for placement proximate to a tone hole on a musical instrument, the push-button octave/register key comprising:

a core sized to fit within the tone hole, the core comprising a sidewall having an elongated aperture therein; and a actuator coupled to the core and pushable to move the core from a first position relative to the musical instrument toward a second position relative to a musical instrument;

wherein the elongated aperture is in fluid communication with an interior portion of the musical instrument in the first position and out of fluid communication with the interior portion of the musical instrument in the second position.

15. The octave/register key of claim 14 wherein the actuator comprises a actuator aperture, and wherein the actuator aperture is in fluid communication with the elongated aperture.

16. The octave/register key of claim 14 wherein the elongated aperture extends a majority of a length of the core and is in fluid communication with ambient air in both the first and second positions.

17. The octave/register key of claim 14, further comprising an actuation reversal component in operable communication with the actuator and configured to restore the core to the second position from the first position.

18. A method of producing one or more harmonics of a fundamental pitch on a musical wind instrument, the method comprising:

establishing an air column in an interior portion of the wind instrument, the wind instrument having a tone hole sealed from communication with ambient air by an octave/register key, wherein the octave/register key has an aperture in fluid communication with the ambient air;

actuating the octave/register key to extend into the air column;

establishing a fluid communication pathway between the air column and the ambient air via the aperture; and disrupting a vibration of the air column.

19. The method of claim 18 wherein actuating the octave/register key comprises pushing a actuator having a actuator fluid pathway therein, and wherein establishing a fluid communication pathway comprises placing the actuator fluid pathway in fluid communication with the air column.

20. The method of claim 18, further comprising automatically restoring the octave/register key to a position that eliminates the fluid communication pathway between the air column and the ambient air.

* * * * *